US007017640B2

(12) United States Patent
Winter et al.

(10) Patent No.: US 7,017,640 B2
(45) Date of Patent: Mar. 28, 2006

(54) METHOD AND APPARATUS FOR MANUFACTURE OF SWATCH-BEARING SHEETS

(76) Inventors: Steven B. Winter, 2139 Grange Ave., Highland Park, IL (US) 60035; Stanley Lerner, 976 Oak Ter., Glencoe, IL (US) 60022

( * ) Notice: Subject to any disclaimer, the term of this patent is extended or adjusted under 35 U.S.C. 154(b) by 236 days.

(21) Appl. No.: 10/071,678

(22) Filed: Feb. 7, 2002

(65) Prior Publication Data

US 2002/0129893 A1 Sep. 19, 2002

Related U.S. Application Data

(60) Provisional application No. 60/267,826, filed on Feb. 9, 2001.

(51) Int. Cl.
*B32B 31/00* (2006.01)

(52) U.S. Cl. ..... 156/562; 156/265; 156/521; 156/561; 271/204

(58) Field of Classification Search ..... 156/264, 156/521, 561, 562, 558, 576, 63, 265, 299; 271/204, 205, 206, 85, 243, 247, 268
See application file for complete search history.

(56) References Cited

U.S. PATENT DOCUMENTS 4,061,521 A 12/1977 Lerner et al.
4,379,696 A 4/1983 Lerner
4,457,718 A 7/1984 Lerner
4,799,664 A * 1/1989 Burger ..... 271/277
5,007,629 A * 4/1991 Eberle et al. ..... 271/277
5,169,285 A * 12/1992 Muller ..... 414/797.8
5,313,884 A 5/1994 Lerner et al.
5,370,024 A 12/1994 Lerner et al.
5,622,594 A 4/1997 Lerner et al.
5,810,347 A * 9/1998 Wingate ..... 271/204
6,030,481 A 2/2000 Winter et al.
6,086,694 A 7/2000 Winter et al.
6,152,441 A * 11/2000 Vossen ..... 271/85

FOREIGN PATENT DOCUMENTS

FR 2717165 A1 * 9/1995

OTHER PUBLICATIONS

English abstract of FR 2717165.*

* cited by examiner

*Primary Examiner*—Jeff H. Aftergut
*Assistant Examiner*—John L. Goff
(74) *Attorney, Agent, or Firm*—Fitch, Even, Tabin & Flannery

(57) ABSTRACT

A method and apparatus are provided for high speed manufacture of swatch bearing sheets wherein each sheet is directed through various operating stations via a single set of sheet engaging members. Individual sheets are removed from a stack of sheets at a feeding station. The sheets are aligned into a predetermined position for feeding to the sheet engaging members. A single set of sheet engaging members directs each sheet through an adhesive applying station where glue spots are placed on the sheets at predetermined locations. Each sheet is then advanced by the same set of sheet engaging members through one or more swatch applying stations where swatches are applied to the glue spots on the sheets. The sheets are then discharged from direction via the sheet engaging members at a disengaging station. The sheets are then fed through a pressing station to firmly adhere the swatches to the glue spots on the sheets.

20 Claims, 22 Drawing Sheets

5
16
60
62
61
6
52
3
100
85
70
50
51
9
15
21
20
11
14
90
209
7A
107
108
106

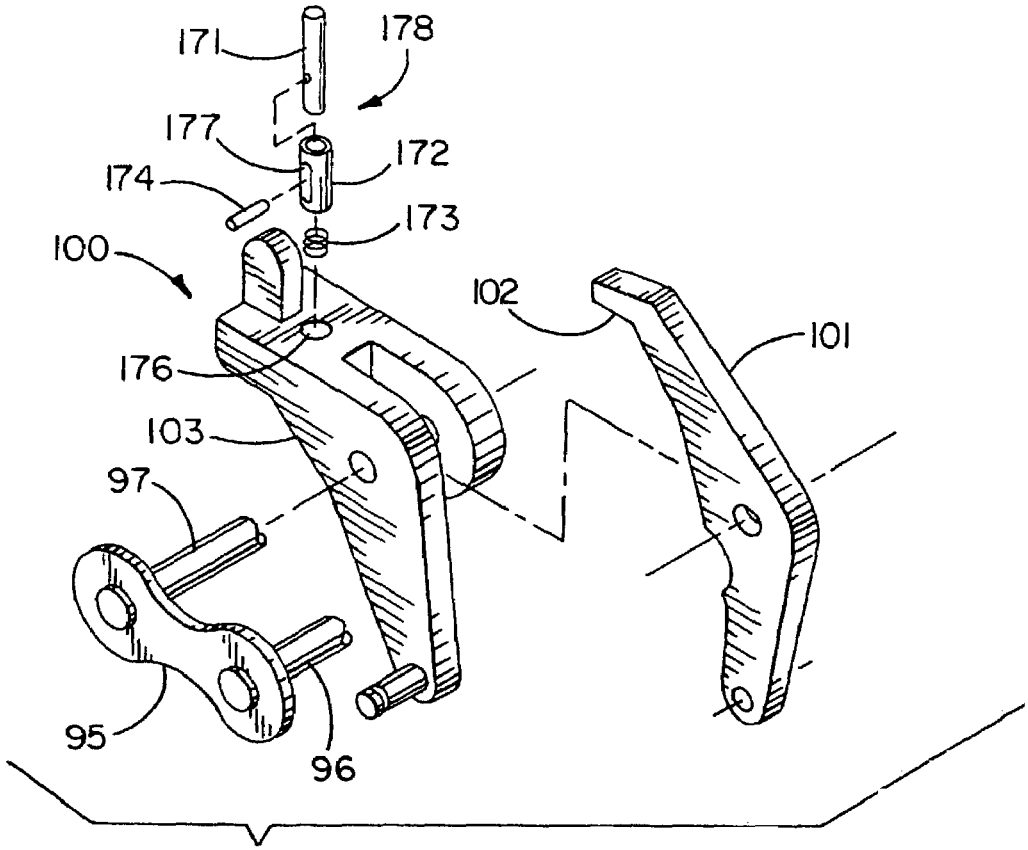
FIG. 9
FIG. 10
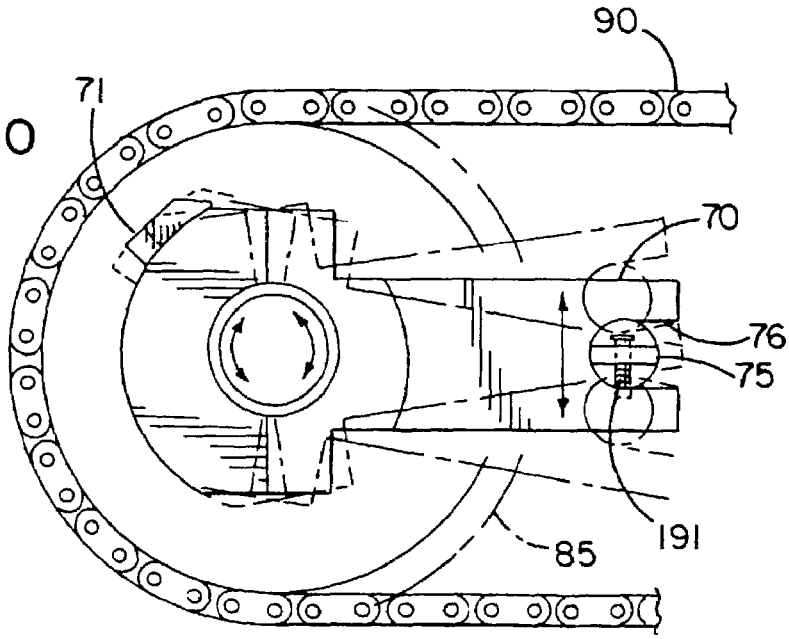

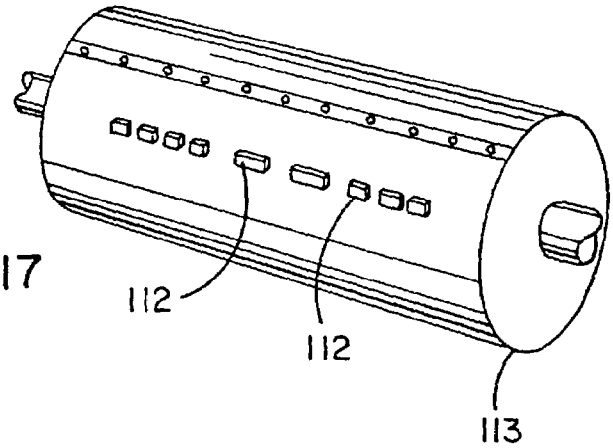
FIG. 17
FIG. 18
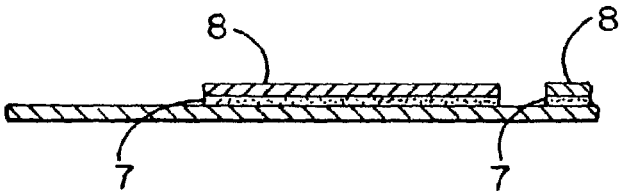
FIG. 19
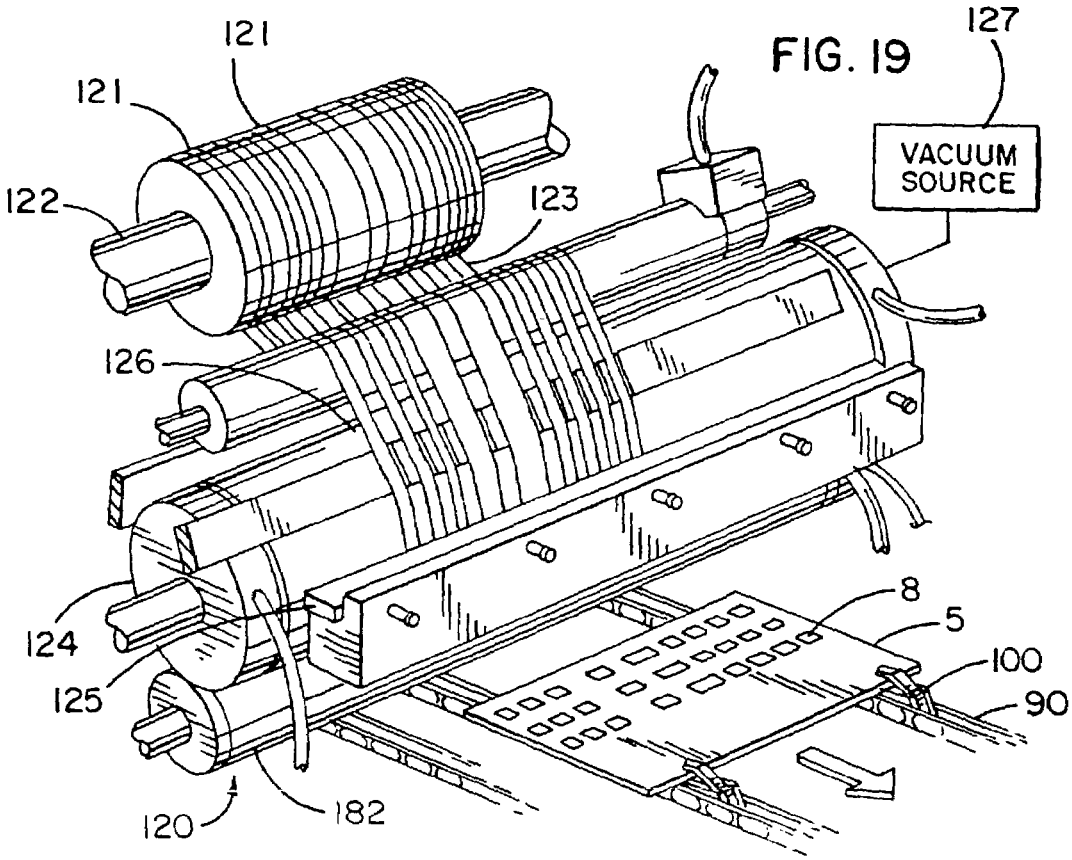

METHOD AND APPARATUS FOR MANUFACTURE OF SWATCH-BEARING SHEETS

This application claims the benefit of U.S. Provisional Application No. 60/267,826, filed on Feb. 9, 2001.

FIELD OF THE INVENTION

The invention relates generally to an apparatus and method of forming sheets with swatches thereon.

BACKGROUND OF THE INVENTION

Currently, a commercial process to apply swatches to a sheet, such as shown in Lerner, et al., U.S. Pat. No. 4,061,521, provides a relatively high speed operation (e.g., 4,500 sheets per hour) in which blank sheets are fed continuously through operating stations including an adhesive applying station and one or more swatch applying station where swatches are applied to the sheet.

Blank sheets are pushed by feed fingers through the adhesive applying station and the swatch applying stations on top of travel surfaces, at least some of which include upstanding guide portions on one side thereof. These side sheet guides are spaced apart a distance corresponding to the width of the sheet to ensure the sheets maintain proper alignment as they are pushed by the feed fingers through the adhesive applying station and the swatch applying stations. Multiple side sheet guides are required throughout the swatch applying machinery to maintain the sheets in proper alignment. Side sheet guides must be placed before and after the adhesive applying station and each swatch applying station to keep the sheets aligned as they are pushed between stations. Because the sheets are pushed at their trailing edges by the feed fingers, without the sheet guides, the sheets may skew sideways, resulting in misfeeds and/or sheets having misaligned swatches thereon.

The feed fingers that push the sheets along the travel surfaces are attached to conveyors in the form of drive chains. Separate drive chain conveyors extend between each of the operating stations so that several sets of feed fingers will have pushed the sheets during their travel from the infeed to the outfeed of the sheets from the machine. The use of multiple sets of conveyers and multiple sets of feed fingers to push each sheet to and from each operating station requires precise coordination of the timing of the positions of each set of feed fingers on each conveyor to push the sheet through the operating stations, particularly where operating speed is maximized. Further, the coordination necessary to push a sheet to an operating station with a first set of feed fingers on a first conveyor and then to have a second set of feed fingers on a second conveyor positioned to push the sheet from the operating station must be precisely timed because errors in the coordination could result in misfeeds or misprinted sheets, requiring the machinery to be stopped to correct the errors and reducing the production efficiency of the machinery.

The feed fingers do not positively grip the sheets. As there is no positive gripping, the feed fingers extend a relatively high distance above the travel surfaces to ensure that they contact the rearward edge of the sheets as occasionally the sheets will not be lying flat on the travel surfaces such as if the rearward edge of the sheet curls.

Because of the height that the feed fingers extend above the travel surfaces and the lack of positive gripping of the sheets, the feed fingers are not able to push the sheets through the stations. More specifically, upper and lower rollers cooperate to form nips of the operating stations into which the sheets are fed and from which they are discharged. In the nips, adhesive and swatches are applied to the sheets. The height of the feed fingers does not allow for their passage through the nip areas between the closely spaced rollers of the operating stations.

Accordingly, instead of using a single set of feed fingers to push the sheets through each operating station, a separate set of feed fingers pushes each of the sheets to each station. The nip formed by the rollers in each station draw the sheets therethrough and discharges them downstream to the next conveyor at which point another set of feed fingers then pushes the sheets to the next station. The timing of the multiple sets of feed fingers must be coordinated so that as a sheet leaves a station a new set of feed fingers are positioned to push the sheet to the next station. If the timing is not correctly coordinated, misfeeds may occur. Misfeeds are undesirable because the swatch applying machinery must be stopped while the misfed sheet or sheets are removed and the machinery reset for continued operation.

The swatch applying machinery can accommodate sheets of different sizes. When a different size of sheet is fed through the swatch applying machinery, each side sheet guide and associated travel surface must be readjusted to maintain the different size of sheet in proper alignment as it travels through the adhesive applying station and the swatch applying stations. Readjusting each side sheet guide in the swatch applying machinery is labor intensive. The time required to properly readjust each side sheet guide when changing the size of the sheet can be as much as four hours. In addition to the costs associated with the labor involved in readjusting the side sheet guides, the swatch applying machine must sit idle during this time.

As sheets are fed through the swatch applying machinery at higher speeds, the sheets have a tendency to float above the travel surfaces. At higher speeds, the front or leading edge of the sheet tends to lift up, allowing air to flow underneath the sheet. The result is a sheet that is partially floating on air. The faster the swatch applying machinery is run, i.e., the more sheets per hour fed through the machine, the greater the tendency for the sheets to float. The problem of sheet float is particularly acute when lighter sheet stocks are used. The use of lighter sheet stock tends to increase the tendency for the sheets to lift up from the travel surfaces because the sheets do not have sufficient weight to maintain themselves in a planar alignment and against the travel surfaces. When sheets float, there are increased occurrences of misfeeds and misprints. Floating sheets tend to deviate from their preferred alignment, even with the assistance of the side sheet guides associated with the travel surfaces. The corners of floating sheets tend to catch on various parts of the swatch applying machinery, causing the sheets to become misaligned.

The problem of floating sheets limits the operating speed of swatch applying machinery. The operating speed of the swatch applying machinery must be reduced below optimal levels to attempt to minimize the occurrence of sheet float. Every time a floating sheet causes a misfeed or misprint, the swatch applying machinery must be stopped, the offending sheet removed, and the machinery reset for continued production. The problem of floating sheets is costly. Labor must be expended to remove sheets that result in misfeeds or misprints. Labor must also be expended to reset the swatch applying machinery for continued production. The time that the swatch applying machinery must remain idle while offending sheets are removed and the machinery reset is costly in terms of lost production time.

Various attempts to reduce the problem of sheet float have been attempted with limited success. The swatch applying machinery may be run at lower speeds. Although this solution may be effective at addressing sheet float, it is desirable to operate the swatch applying machinery at higher speeds to increase production of finished sheets with applied swatches. Another attempt at reducing the occurrence of sheet float involves placing sheet hold-down guides throughout the swatch applying machinery. Sheet hold-down guides may be placed between the stations to help maintain the sheets in contact with the travel surfaces. Although sheet hold-down guides help address the problem of sheet float, because the leading edges of the sheets may still lift up from the travel surfaces during high speed operation of the machinery during the time they are not being held down by the guides against the travel surfaces.

Accordingly, a method and apparatus are needed for directing a sheet through swatch applying machinery that reduce the setup time required for changing sheet sizes, reduce problems associated with the occurrence of sheet float, and which allow for higher speed operation of the swatch applying machinery and thus more efficient and increased production rates of sheets with swatches applied thereon.

SUMMARY OF THE INVENTION

In accordance with the present invention, an apparatus and method are provided for high speed manufacture of swatch bearing sheets. The apparatus and method employ an improved system for directing the sheets in their downstream travel direction through the various operating stations via sheet engaging members that stay in engagement with the sheets as they travel through the operating stations. In this manner, individual conveyors including associated sheet engaging members for feeding the sheets to each operating station are avoided, including the need to have these appropriately timed relative to each other so that the members associated with an upstream conveyor release the sheet for feeding it to an operating station with the members associated with the adjacent downstream conveyor timed to come up from behind the sheet and engage its trailing edge after it exits the upstream operating station for directing the sheet to the operating station adjacent its discharge end.

In a preferred form, the sheet engaging members herein are grippers that pull the sheets at their leading edges through the operating stations. Clamping the sheets at their leading edges and pulling them in their downstream travel direction is advantageous over the feed fingers used in prior machines having separate conveyors for feeding the sheets to each operating station as the feed fingers abutted the trailing edges and pushed the sheets. By clamping and pulling the sheets, the grippers maintain the leading edges of the sheets down substantially irrespective of the conveyor operating speed, eliminating occurrences of sheet float and thereby allowing for increased throughput with the present apparatus and method.

In addition, only abutting the trailing edges of the sheets with the feed fingers did not provide adequate control over the alignment of the sheets as they were moved in their downstream travel direction, particularly during high speed operations. For this purpose, upstanding guide portions or sheet guides of the travel surfaces are used in the prior machines on both sides of each of the conveyors. Each change in the spacing of the sheet guides from each other required time consuming adjustment operations to ensure the sheet guides for each of the different conveyors were properly adjusted. By contrast, because the present grippers clamp on the leading edges of the sheets, the sheets generally will not become misaligned as they travel downstream, thus substantially eliminating the need for sheet guides as previously required and the time consuming adjustment and alignment operations they necessitated, such as each time the sheet size to be run changes.

The grippers are preferably a pair of clamping members in the form of pivotable jaws that are biased to a closed position. An actuator causes the jaw to pivot to an open position for receiving the leading edge of the sheet as delivered by a sheet feeder. The delivery of the sheet and opening of the jaws are precisely timed so that high speed operations can occur with the sheet transferred to the grippers at a high feed rate. More particularly, the sheets are controllably fed so that at the time of being clamped, there is little relative motion between the grippers and the sheets, as described more fully herein. With the leading edge of the sheet fed into position between the open jaws, the bias of the grippers causes the jaws to clamp on the leading edge to begin pulling the sheet downstream toward the initial operating station, i.e., the adhesive applying station. The size of the spacing between the opened gripper clamp members is closely coordinated with the predetermined bias for closing the clamp members so that the sheets are clamped substantially at the same location even when changing the operating speed. In this regard, the spacing between the opened gripper clamp members can not be so large that the time it takes for the bias force to urge the gripper members closed is sufficiently long for significant variations to be introduced into the position at which the sheets are gripped. Inconsistencies can generate misalignment of the swatches relative to the predetermined locations on the sheet to which they are supposed to be adhered.

The sheet feeder can include a vacuum delivery mechanism and a sheet stop that cooperate to deliver the sheets to the grippers in timed sequence with the opening of the gripper jaws. The vacuum mechanism can include a plurality of vacuum heads to which a vacuum is applied when a sheet in the feeder moves into alignment therewith abutted against the stop. With the vacuum heads drawing the sheet into engagement therewith, the vacuum heads deliver the leading edge of the sheet into the space between the open gripper jaws. Preferably, the vacuum heads shift for feeding the sheet in the downstream travel direction, and the vacuum is removed at the precise time the leading edge of the sheet is in position to be clamped between the gripper jaws. Even more preferably, the stop also shifts to provide clearance for the sheet as the vacuum heads feed the sheet to the grippers. Accordingly, the shifting of the vacuum heads and stop are precisely coordinated with the actuation of the grippers for feeding the sheets thereto with the jaws thereof opened.

The vacuum is removed from the heads to allow the grippers clamped on the sheets to pull them downstream to the adhesive applying station and the swatch applying stations downstream therefrom. The vacuum heads are preferably mounted to a pivot shaft so that they pivot or rock when feeding a sheet to the grippers. As the grippers are connected to the conveyor or chain, they travel around a sprocket at the upstream end of the conveyor and are opened as they approach the upper run of the conveyor. As they begin to travel away from the vacuum heads, rotation of the pivot shaft rocks the vacuum heads toward the grippers so that both the grippers and vacuum heads are moving in the same general downstream direction. In other words, the grippers travel in an arc about the sprocket, and the vacuum heads pivot in an arc about the rotating pivot shaft, with the arcs generally coinciding such that the sheet is properly fed into the space between the open gripper members so that as they close there is little relative motion between the sheet and the grippers. It has been found that having the sheet controllably fed to the gripper as both move in the same general direction minimizes the instances of slippage between the grippers and sheet during the transfer and clamping of the sheet by the grippers. Further, the speed of pivoting of the vacuum heads is timed to the conveyor speed. This along with the appropriate sizing of the closing bias force on the grippers and the size of the space between the opened clamp members as has been discussed contribute to a consistent grip of the sheets in terms of the location at which they are clamped by the closed gripper clamp members, particularly during high speed operation.

After the sheets have the adhesive applied and the swatches thereon, they are discharged from the conveyor at the downstream end thereof. For this purpose, a discharge nip is formed as each sheet is moved into alignment therewith for directing the sheet downstream therefrom for further processing or the like. In the preferred form, the nip is formed by at least one set of wheels with one of the wheels being driven for rotation. The other wheel is a counter wheel and rotates when forming the discharge nip with the driven wheel. As the sheet is pulled by the grippers toward the area between the wheels, the counter wheel is shifted to provide clearance for the sheet. With the sheet aligned between the wheels, the grippers are opened and the counter wheel is shifted toward the driven wheel to form the nip therewith, for discharging the sheet therefrom.

More specifically, the counter wheels are each mounted to a bracket clamped to a rotary bar having rod-shaped end portions mounted for rotation in bearing blocks on either side of the conveyor. An actuator is fixedly connected to the rotary bar at one end and includes a wheel at its other end that is engaged by a cam portion of a wheel in timed relation to the arrival of a sheet upstream from the discharge mechanism. The engagement of the cam portion with the actuator wheel shifts the actuator, thus causing rotation of the bar and lifting the counter wheel so that there is no interference as the sheet, having its upstream end slightly raised by the grippers clamped thereon, is brought onto the driven, lower wheel. At this time, a gripper actuator is operable to open the jaws and the wheel cam disengages from the actuator wheel allowing the actuator to shift back to its non-actuating position with the bar rotating, and the upper counter wheel dropping onto the sheet. In this manner, the discharge nip maintains control over the sheet after the grippers have released the sheet for discharge from the conveyor.

Turning next to more of the details, the swatch applying machinery adheres swatches at predetermined locations on the sheet. The swatches may be arranged in an array of rows and columns on the sheet. The swatches may all be of similar dimensions, or the swatches may be of differing sizes. The swatches preferably comprise color samples, such as colors of wall paint, caulk, or automotive paint. The sheets with color samples attached thereto are presentable to consumers to display the various color samples.

The swatch applying machinery preferably comprises a feeding station, an adhesive applying station, one or more swatch applying stations, a disengaging station, and a pressing station. The feeding station separates individual sheets from a stack of sheets and moves the sheets to the gripper mechanisms. The gripper mechanisms then pull the sheets in a direction of travel through the adhesive applying station where one or more adhesive or glue spots are applied to the sheets. The gripper mechanisms then pull the sheets through the swatch applying stations where swatches are applied to the adhesive or glue spots. The gripper mechanisms then are released from the sheets at the disengaging station. The sheets are then moved from the disengaging station to a pressing station where the swatches are firmly pressed onto the adhesive or glue spots on the sheets.

Multiple parallel gripper mechanisms are provided for pulling the sheets through the swatch applying machinery. It is preferable to have at least two parallel gripper mechanisms grip each sheet and pull the sheet through the swatch applying machinery. The use of at least two parallel grippers for clamping each sheet helps maintain the orientation of the sheet as the sheet is pulled through the operating stations. The swatch applying machinery is preferably provided with four parallel gripper mechanisms for pulling sheets of large width. Two parallel gripper mechanisms may used sufficiently for pulling sheets of less width.

The feeding station preferably includes an inclined sheet feed hopper. Stacks of blank sheets may be placed on the inclined sheet feed hoper. The sheets are then flipped over and onto the indexing portion of the feeding station such that they are stacked in a shingle-like manner with an exposed leading edge in the direction of travel. Belts may be placed on the indexing portion to move the sheets in the direction of travel to a rotating suction wheel. The rotating suction wheel is mounted to a rotating suction wheel shaft. Multiple holes are disposed around the circumference of the rotating suction wheel. Suction from a vacuum source may then be applied through the shaft to the holes of the rotating suction wheel. The rotating suction wheel then rotates and the suction at the holes removes a sheet by the leading edge of the sheet from the stack of sheets and moves the sheet in the direction of travel to the feed portion of the feeding station.

The feeding station preferably includes a feed plate. At each end of the feed plate are feed belt drive rollers. Feed belts wrap around the feed belt drive rollers and around the feed plate and rotate therearound to move the sheets over the feed plate. Freely rotatably feed wheels are disposed directly above some or all of the feed belts to maintain the sheets in contact therewith. The feed wheels may include rubber on their circumferential edge to reduce slipping between the sheets and the feed wheels and to ensure that while the sheets are on the feed belts and below the feed wheels with rubber thereon the sheets advance at the same rate the feed belts are moving.

As the sheets are fed along the feed plate, a pusher plate pushes the sheets transversely to the travel direction toward a guide rail so that each sheet is consistently positioned in alignment with the guide rail. The guide rail is positioned on a side of the feed plate and is preferably adjustably attached to slots formed in the feed plate. The guide rail may have a spring member on a side facing the pusher plate so that sheets pushed thereagainst will not tend to rebound back towards the pusher plate as a result of the slight impact force between the sheet and the guide rail that otherwise may occur if the guide rail had no spring to absorb the slight impact with the sheet. The pusher plate is laterally slidable on an opposite side of the feed plate from the side of the feed plate with the guide rail. The pusher plate preferably slides relative to the feed plate at the urging of an actuator plate member. The plate member slides in an oblique direction to the downstream travel direction upstream and laterally towards the guide rail on posts that protrude through oblique slots formed therein when urged by operation of an actuator mechanism including an associated cam wheel, described more fully herein.

The sheets are preferably fed along the feed tray by the feed belts and are stopped at the end of the feed tray by a sheet stop. The sheet stop includes a stop bar with stop members that extend in an upward direction and extend above the surface of the feed plate. As the sheets are fed to the end of the feed plate, the leading edges thereof abut against the stop members of the sheet stop. When a sheet is in abutment with the stop members, the feed belts continue to move in the downstream direction of travel but the sheet remains stationary due to the stop members.

The feed wheels proximate the end of the feed plate preferably have bristles around their circumferential edge. The bristles maintain the sheets against the feed belts while the bristles tend to resist lifting or pushing the trailing edge of the sheet when the leading edge of the sheet is in abutment with the stop members. The bristles are advantageous over the high friction contact the rubber provides with the sheets on the upstream wheels as the bristles act to maintain the sheets in engagement with the feed belts when directly thereunder, but also are forgiving enough so that rather than pushing the sheets against the stops with a force that can damage the sheets or cause sheets to misfeed, once the stops arrest the downstream travel of the sheets, the bristles will resiliently flex as they rotate over and past the sheet so as to not change its configuration or orientation while the sheet is in position to be fed to the grippers. The bristles still maintain the sheet in contact with the feed belts when the sheets are substantially under the bristles so that the sheet may advance downstream, but the give inherent in the bristles resists their pushing against the trailing edge of the sheet when the sheet is in abutment with the sheet stops.

A suction feeder is preferably disposed over the feed plate and near the end of the feed plate. The suction feeder includes one or more suction heads mounted to a suction feeder shaft. Suction may be selectively applied from a vacuum source to the suction heads. When a sheet is in abutment with the stop members, suction may be applied to the suction heads, thereby drawing the leading edge of the sheet to the suction heads. The suction feeder shaft then pivots the suction heads and leading edge of the sheet in the direction of travel. As the suction feeder shaft pivots, the stop bar of the sheet stop pivots, moving the stop members to a position below the upper surface of the feed plate so that the stop members do not interfere with the sheet as the sheet is pivoted in the direction of travel by the suction heads.

Travel surfaces are positioned before and after each operating station to provide a surface for the sheets to slide upon as they are pulled through the stations. The travel surfaces are preferably planar metal plates and can be coated with teflon or other low friction materials to reduce friction between the travel plates and the sheets as the sheets slide thereover. Coating the plates with teflon also facilitates removal of glue or adhesive that may inadvertently become deposited thereon. If glue or adhesive is on the travel plates, the travel of the sheets across the surface of the travel plates may be hindered. The travel plates preferably have slots extending in the direction of travel from an infeed end before the adhesive applying station to the outfeed end proximate the disengaging station through which the gripper mechanisms protrude.

Disposed beneath the travel plates are pairs of endless chains arranged in parallel. Pairs of endless chains extend between corresponding pairs of drive and idler sprockets located at the beginning and ending of the arrangement of operating stations. It is preferable to have pairs of endless chains spaced a close distance apart with the gripper mechanisms held therebetween. As the conveyor herein in the form of endless chains continuously extends from upstream of the operating stations, therethrough, and downstream therefrom, only a single set of grippers engage a sheet during its processing through each of the operating stations, i.e., adhesive and swatch applying stations. The endless chains are positioned such that the gripper mechanisms held therebetween are aligned with the slots formed in the travel plates.

The chains are of standard construction and comprise multiple chain links. The links have two side plates spaced a distance apart with two pins connecting the plates to each other. Each one of the pins connects each link to adjacent links in the chain.

Chain sag was not an issue in the prior machines described previously because the previous conveyors only extended the relatively short distances between operating stations, but can occur in the present invention because the chains span the complete arrangement of operating stations. The portions of the runs of the endless chains extending in the direction of travel have chain support slides that the chains rest and slide upon during travel. The chair support slides preferably include narrow plastic runners that the pins of the links of the chains run upon, thereby providing a low-friction method of preventing the chains from sagging as they span the long distance between the sprockets.

The sprockets are mounted to rotatable shafts positioned at each end of the travel surfaces. The sprockets have teeth around their circumference for intermeshing with the endless chains. Drive sprockets are preferably mounted under the travel plates near the disengaging station and idler sprockets are preferably mounted under the travel plates near the feeding station. The location of the drive and idler sprockets may be swapped, i.e., the idler sprockets may be placed under the travel plates near the disengaging station and the drive sprockets may be placed under the travel plates near their infeed end. In the preferred embodiment of the invention, the sprockets are in paired sets corresponding to the pairs of endless chains with grippers therebetween. The paired sets of sprockets have a groove in between them to allow the gripper mechanisms to pass therebetween without interference.

Gripper mechanisms are preferably attached to cross links at predetermined, spaced intervals between pairs of the endless chains. Portions of the gripper mechanisms protrude through the slots formed in the travel plates. The protruding portion of the gripper mechanism is minimal so that the protruding portion may travel through the adhesive applying station and the swatch applying stations while gripping a sheet, thereby eliminating the need to have separate conveyor mechanisms deliver the sheets to and from each operating station, as previously discussed hereinabove. In the preferred embodiment of the invention, the gripper mechanisms protrude only about one-eighth of an inch above the upper surface of the travel plates. Each gripper mechanism preferably has an upper jaw and a lower jaw that are pivotally connected. The gripper mechanism has an open position and a closed position. In the open position, the jaws of the gripper mechanism are spaced apart for insertion or removal of a sheet. In the closed position the jaws of the gripper mechanism firmly hold or clamp the sheet therebetween. Springs attached to associated spring attachment legs placed forward of each gripper mechanism and between pairs of endless chains bias the upper jaws into contact with the lower jaws.

Actuators are disposed near each sprocket to open the gripper mechanisms while the gripper mechanisms are in contact therewith. The actuators preferably comprise cam members mounted to cam discs. A cam disc is provided for each pair of endless chains proximate both the drive sprocket and the idler sprocket. The location of the cam members relative to the sprockets is readily adjustable by movement of the cam discs.

The timing of the gripper mechanism moving between its open and closed positions is dependent upon the speed the chains move the gripper mechanisms, the tension of the respective springs connecting the upper and lower jaws with their corresponding spring attachment legs, and the profiles of the cam members. The profile of the cam members can be changed to alter the timing of the gripper mechanism moving to its open and closed positions, respectively. For example, the profiles of the cam members proximate the feeding station are carefully programmed to control the amount of time that the gripper mechanisms remain in their open positions and to facilitate correct insertion of the leading edges of the sheets into the gripper mechanisms in their open positions and the subsequent clamping thereupon.

More specifically, each cam member proximate the infeed is configured so that the gripper members shift to their maximum spacing between each other in the open position very quickly upon the grippers encountering the cam members. Each cam member is profiled so that this maximum open position is maintained for a sufficient duration to allow a sheet to be readily fed into the relatively large space between the gripper members, thereby minimizing the chance for misfeeds to occur.

Once the sheet is properly fed between the open gripper members, the profile of each cam member is programmed to cause the gripper members to shift to reduce the spacing therebetween for minimizing the impact force against the sheet when clamped onto by the gripper members. Finally, with the gripper members at their minimum spacing, the cam members are configured to allow the grippers to clamp onto the sheet for securely pulling the sheet downstream and through the various operating stations. By causing clamping of the gripper members on the sheet from a minimum spacing, the impact force of the gripper members on the sheet will be lowered and the time to clamp will be lessened, thereby increasing the accuracy in terms of consistently gripping each sheet at a predetermined location adjacent its leading edge. As is apparent, the cams are configured to provide different stages to the spacing between the gripper members to allow the sheets to be fed to a wide space between the gripper members while minimizing the chance that undesirable damage to the sheets will occur upon clamping of the gripper members thereon by progressively closing them prior to the clamping action on the sheets.

The cam members proximate the outfeed are configured so that the gripper members shift to their maximum spacing between each other in the open position very quickly upon the grippers encountering the cam members. Once the sheet has been removed from between the gripper members, the profile of each cam member allows the gripper members to quickly return to their closed positions. The grippers can close rapidly from their maximum open positions because the sheets have been removed from between the gripper members instead of inserted therebetween, as proximate the infeed of the apparatus. Thus, the concerns mentioned above regarding damaging the sheets by the clamping action thereon are not relevant after the sheets have been removed from between the gripper members proximate the outfeed of the apparatus.

The adhesive applying station deposits adhesive or glue spots on predetermined locations on the sheets as the sheets are pulled through the station by the gripper mechanisms. An application roller carries, on its surface, rows of application pads which have substantially the same predetermined lateral spacing as that for the swatches desired in the finished sheets. In addition to the predetermined lateral spacing, the application pads also have a surface area substantially corresponding to that of the swatch sizes to be attached to the sheets. The application roller may be readily replaced with another application roller having a different arrangement of application pads located thereon for producing a different array of adhesive or glue spots on the sheets as the application roller rotates over the sheets.

The application pads are preferably formed of a rubber material with a thickness of about the same as the elevations the gripper mechanisms protrude above the surface of the travel plates to allow the gripper mechanisms to pass under the application roller without catching thereon. Directly below the application roller and extending perpendicular to the direction of travel in a gap between the travel plates is a bar with a slight concave. The concave shape allows the application pads, rotating on the application roller, to gradually press against a sheet thereunder as the application roller rotates instead of pinching the sheet as the application pads press thereon. Give inherent in the rubber material forming the application pads also reduces the pinching of the sheet between the bar and the application pads. The bar, about one inch wide, has slots formed therein corresponding to the longitudinal slots formed in the travel places for the gripper mechanism to protrude therethrough.

Located in the downstream direction from the adhesive applying station and above the travel plates are one or more swatch applying stations. Each swatch applying station preferably deposits one row of swatches on the adhesive or glue spots on the sheets as each sheet passes through the respective swatch applying station. At the swatch applying station, rolls of ribbons are rotatably disposed on a roll bar for simultaneous unwinding. A number of tensioning mechanisms such as tension rollers may be provided to prepare the ribbons for severing into swatches. The ribbons are brought into contact with a swatch roller as they unwind from the rolls. The swatch roller has suction holes around its circumference. Suction applied to the suction holes help maintain the ribbons in contact with the swatch roller. The swatch roller has a severing bar disposed thereon. As the swatch roller rotates, pulling the ribbon therewith, the severing bar contacts a severing blade. The contact of the severing bar with the severing blade severs swatches from the ribbons. The swatches are maintained in contact with the swatch roller by suction applied to the suction holes of the swatch roller. As the swatch roller continues to rotate, the vacuum is released from the swatch roller and the individual swatches are transferred to a suction strip on a transfer roller and adhered thereto with suction.

The transfer roller is a cylinder with the suction strip extending parallel to its axis and along its outer circumference. The suction strip is relatively narrow and has multiple suction holes disposed thereon for adhering swatches thereto. Disposed directly below the axis of the transfer roller and in a gap between the travel plates is a rocker bar. The rocker bar extends perpendicular to the direction of travel and is about an inch wide. The transfer roller and suction strip are sized such that when the transfer roller is rotating and the suction strip is not aligned directly above the rocker bar, the protruding portion of the gripper mechanism can pass unobtrusively between the cylinder of the transfer roller and the rocker bar and within slots formed in the rocker bar corresponding to the longitudinal slots of the travel plates. When the gripper mechanisms have passed the rocker bar, the suction strip with swatches adhered by vacuum thereon rotates down to the rocker bar and presses the swatches to the glue spots on the sheet thereunder. As the suction strip begins to press the swatches to the sheet, the rocker bar rocks downward in a motion corresponding to the motion of the suction strip. The rocking motion of the rocking bar, actuated by a cam member extending from a shaft located under the rocker bar and in contact therewith, reduces pinching of the swatch between the suction strip and the rocker bar and helps ensure that the swatches are accurately placed on the glue spots of the sheets therebetween. Without the rocking motion, the swatches may become pinched between the rocker bar and the suction strip and misaligned.

The gripper mechanisms then pull the sheets to the disengaging station, disposed downstream of the swatch applying stations. The gripper mechanism releases the sheet at the disengaging station. Drive sprockets are preferably disposed beneath the travel plates by the disengaging station. Cam discs with cam members are provided thereon. As the gripper mechanism is contacted by the cam member the sheet is removed from the jaws of the gripper mechanism. Disengaging wheels preferably protrude through slots in the travel plates at the disengaging station to remove the sheet from the gripper mechanism in its open position and feed the sheet in the downstream direction. After releasing the sheet the gripper mechanisms rotate with the endless chains around the drive sprockets and back to the beginning of the travel plates for receiving another sheet from the feeding station.

Hold-down wheels are preferably provided to maintain the sheet in contact with the disengaging wheels after the sheet has been released from the gripper mechanism. The hold-down wheels may be rotatably mounted to a hold-down bar that extends across the width of the travel plates by the disengaging station. The hold-down bar is pivotably mounted and has an attached disengaging bar. A disengaging cam wheel with a disengaging cam is preferably disposed by the disengaging station. The disengaging cam wheel is designed to make one revolution for each sheet that passes through the disengaging station. As the disengaging cam wheel rotates, the disengaging cam member pushes against the disengaging bar, thereby pivoting the hold-down shaft and attached disengaging wheels upward from the travel plates. The lifting of the hold-down wheels allows for the sheet to be pulled by the gripper mechanisms to the disengaging station without interference. As the disengaging cam wheel continues to rotate, the disengaging cam is removed from contact with the disengaging bar, thereby allowing the hold-down shaft with attached hold-down wheels to pivot into contact with the sheet, released from the gripper mechanisms, and maintain the sheet in contact with the disengaging wheels.

The continuing rotation of the disengaging wheels feeds the sheet forward to the pressing station downstream of the disengaging station. The pressing station firmly presses the swatches onto the adhesive or glue spots on the sheets. The pressing station may include multiple pressing rollers aligned on top and bottom surfaces of the sheet. The pressing rollers preferably both press the swatches on the sheets and feed the sheets in a downstream-direction.

A receiving station may be placed downstream of the pressing station to receive the sheets with swatches applied thereto. The receiving station may be adapted to automatically package quantities of sheets with swatches applied thereto. Various operating stations may be placed after the pressing station and before the receiving station. For example, a slicing station may be utilized to slice a single sheet into multiple sheets. A folding station may also be used to fold the sheets.

Multiple sensors may be placed throughout the apparatus to detect the presence of sheets or to detect errors in the feeding of the sheets. For example, optical sensors are preferably placed directly before the sheet stop and before and after the adhesive applying station to detect the presence of sheets. If sheets are not detected at the appropriate times by the sensors, an error is likely and the apparatus is paused. The sensor after the adhesive applying station may also count the number of sheets fed thereover to maintain an accurate count of sheets run through the machine. In addition, an optical beam may be provided across the travel plates and generally perpendicular to the direction of travel. The beam is preferably placed before the adhesive applying station and at a height above the elevation that the gripper mechanisms protrude through the slots in the travel plates. If the gripper mechanism is not below the maximum height that the mechanism is allowed to protrude above the surface of the travel plates, then the errant portion extending thereabove will break the beam and trigger the stoppage of the apparatus. For example, if the spring biasing the upper jaw of the gripper mechanism against the lower jaw breaks and the upper jaw extends above the maximum clearance height that the gripper may protrude above the surface of the travel plates, the subsequent interruption of the beam stops the apparatus.

BRIEF DESCRIPTION OF THE DRAWINGS

FIG. 9 is an exploded perspective view of the gripper mechanism showing the upper and lower jaws thereof, the sheet stop, and a cross link.

FIG. 10 is an elevation view of the cam disc, showing the cam adjusted to different peripheral positions.

FIG. 17 is a perspective view of the application roller of the adhesive applying station of FIG. 16.

FIG. 18 is a cross-sectional view of a sheet showing an adhesive or glue spot with a swatch attached thereon.

FIG. 19 is a perspective view of a swatch applying station of the apparatus of FIG. 1.

DETAILED DESCRIPTION OF THE PREFERRED EMBODIMENTS

Figure 1:
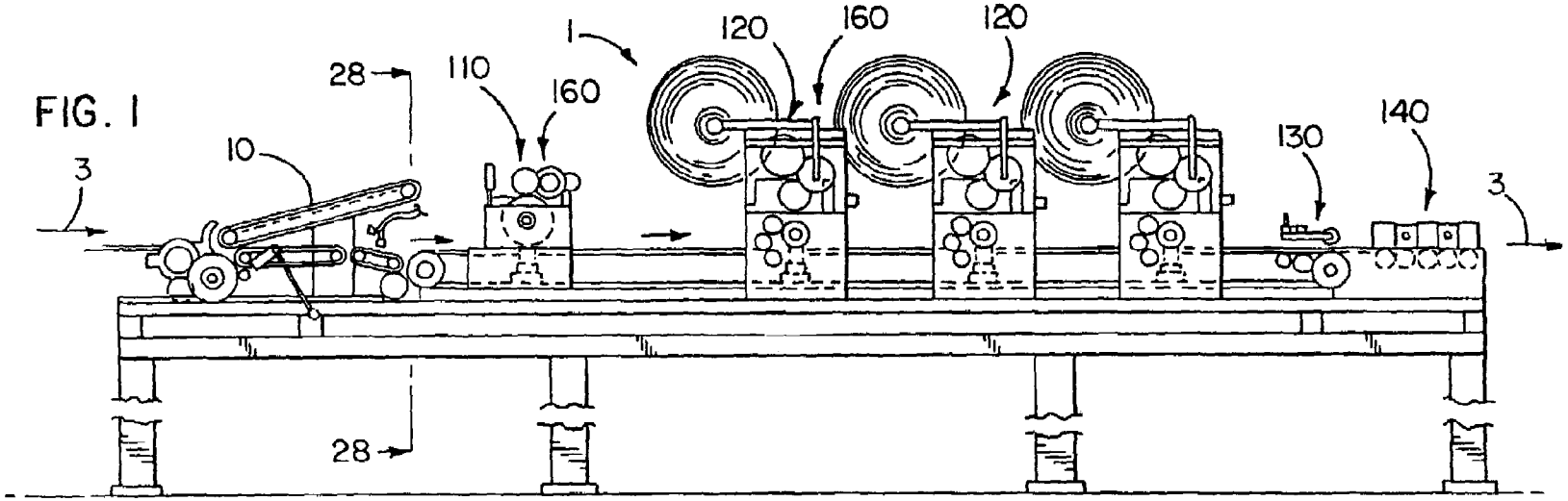
FIG. 1 is an elevation view of an apparatus for adhering swatches in rows on sheets at predetermined locations in accordance with an embodiment of the invention.
Figure 3:
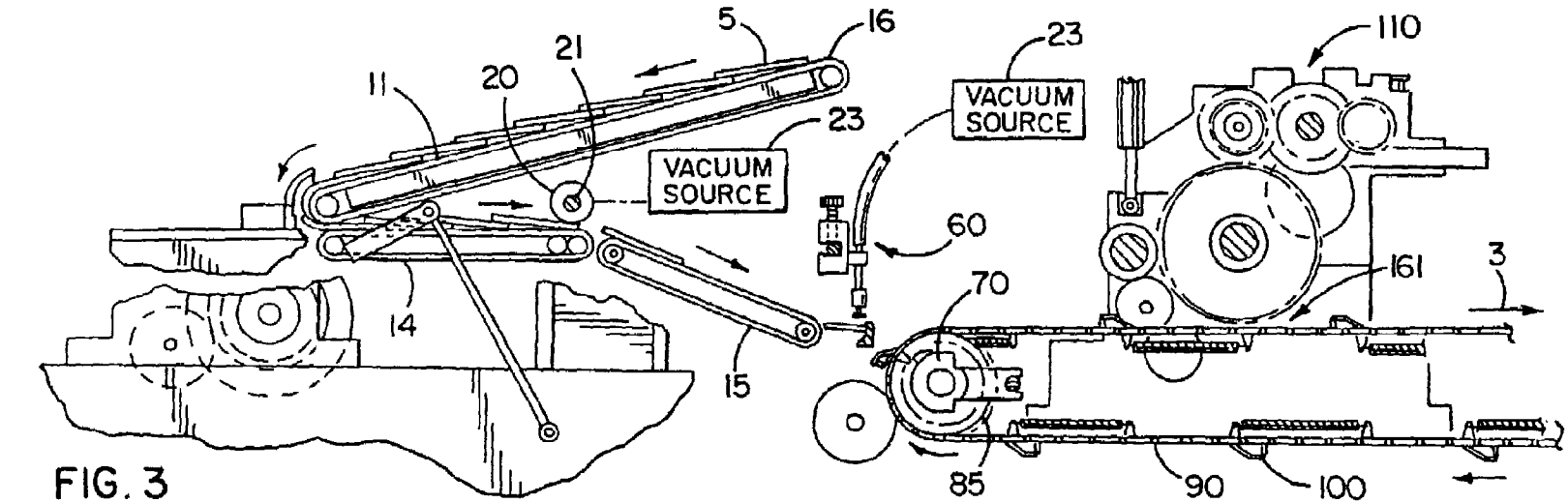
FIG. 3 is an elevation view of an inclined sheet feed hopper, indexing and feed portions of the feeding station, and an adhesive applying station of the apparatus of FIG. 1.
Figure 2:
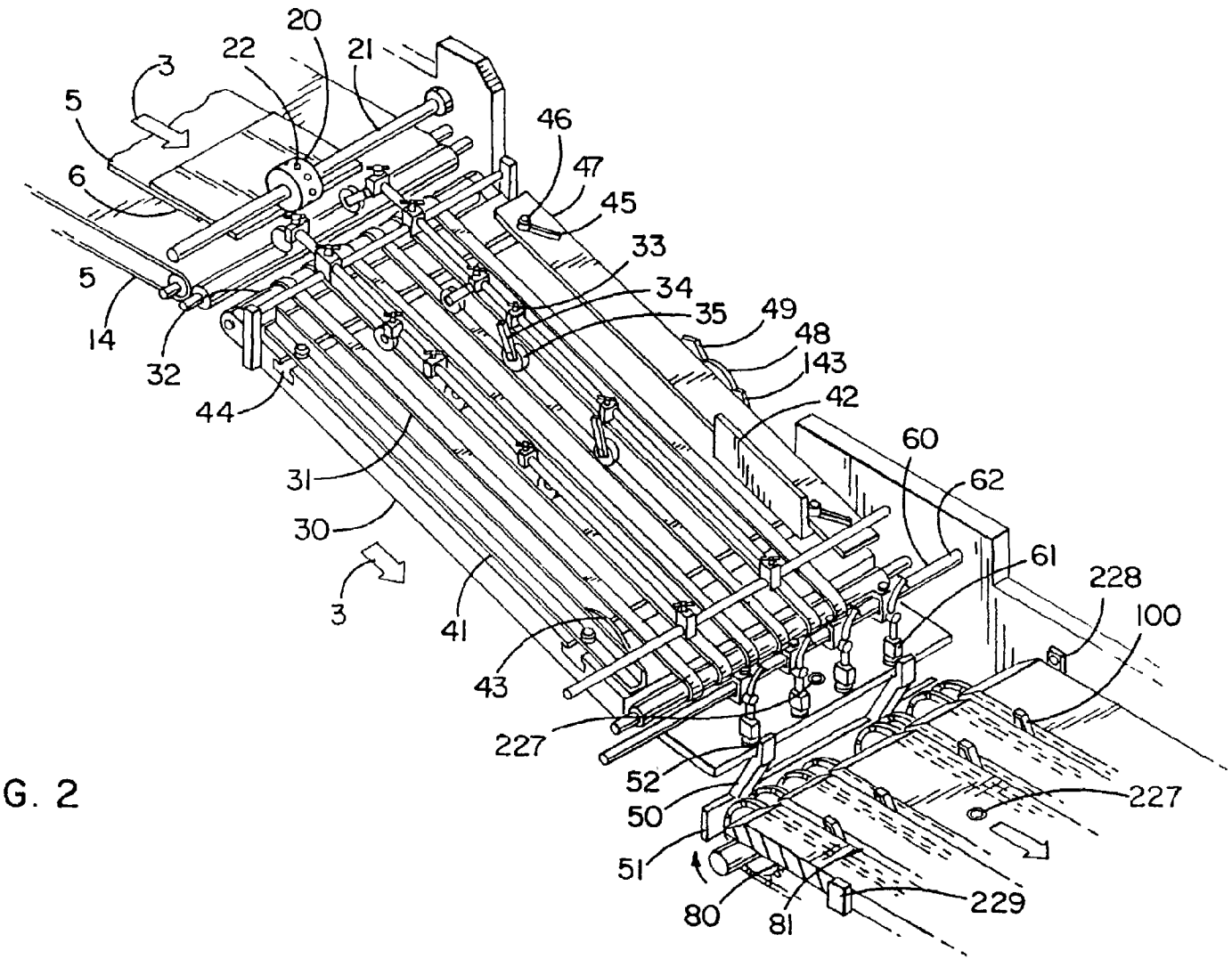
FIG. 2 is a perspective view of the feeding station of the apparatus of FIG. 1.
Figure 5:
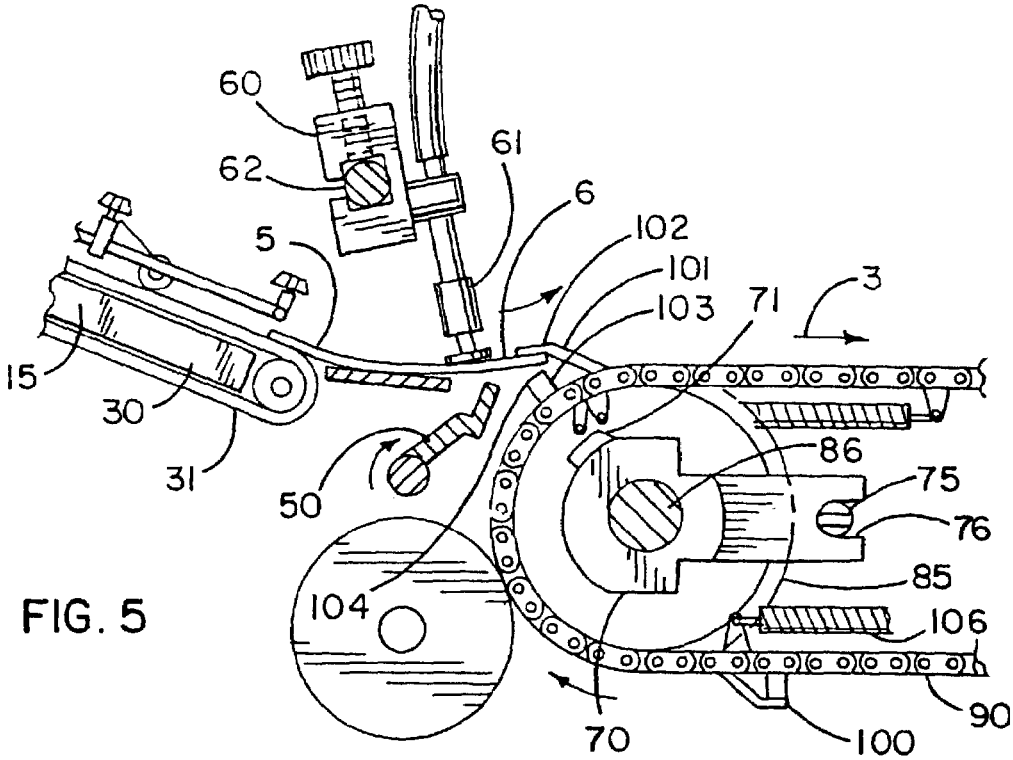
FIG. 5 is an elevation view similar to FIG. 4 showing the sheet drawn to the suction feeder, the suction feeder in its second position with suction applied thereto, and the gripper mechanism in its open position.
Figure 6:
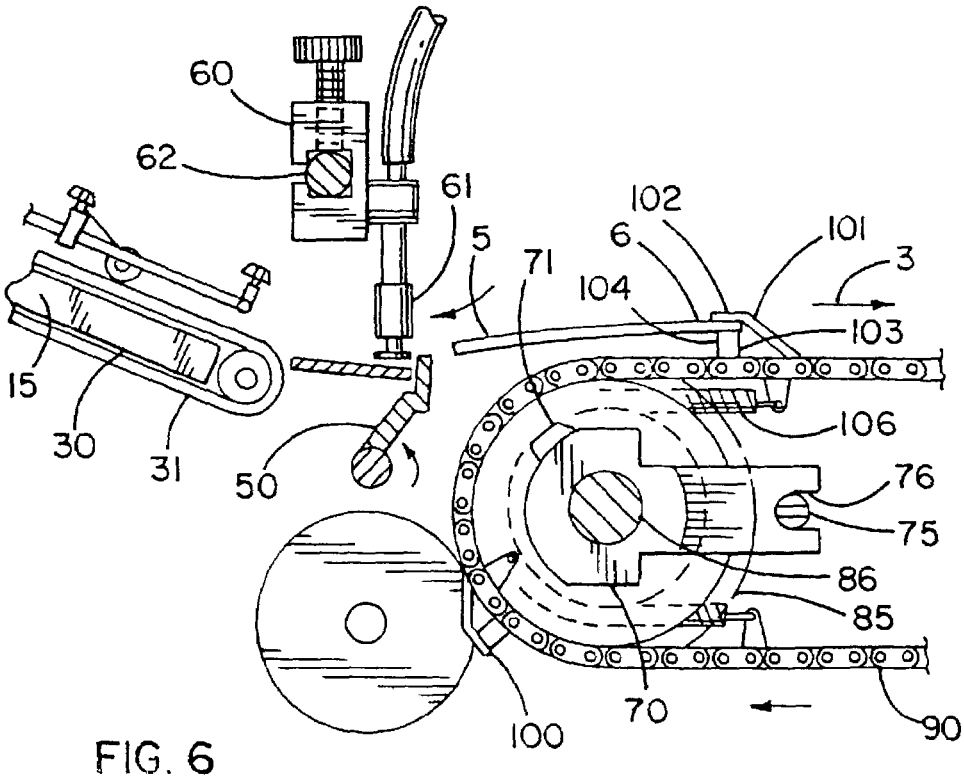
FIG. 6 is a view similar to FIGS. 4 and 5 showing the sheet being pulled in a downstream direction by the gripper mechanism, a next sheet feeding down the inclined feed tray, and the suction feeder in its first position without suction applied thereto.

In FIGS. 1–3 an apparatus 1 for applying swatches 8 to sheets 5 in accordance with the present invention is illustrated. The present apparatus 1 and method performed thereby enable much higher production rates of swatch bearing sheets 5 and minimize the need to perform time consuming set-up operations to tailor the machine for the sheet size being run. The apparatus 1 includes a single conveyor on which the sheets 5 travel through each of the operating stations, generally designated 160. In this regard, the present apparatus 1 and method employ a single set of sheet engaging members associated with a sheet 5 for directing it downstream through the operating stations 160, as shown in FIGS. 3, 5, and 6. Thus, the apparatus 1 and method herein are much simpler than those machines using a separate set of sheet engaging members for each operating station as the previously discussed timing issues for proper transfer of the sheets between sets of members are avoided.

In the preferred and illustrated form, the sheet engaging members are grippers 100, as best seen in FIGS. 7, 7A, and 11–15. As shown in FIGS. 5 and 6, the grippers 100 are operable to clamp onto the leading edge 6 of the sheets 5 for pulling them downstream through the operating stations 160. With the sheet 5 clamped by the grippers 100, the grippers 100 will only have a small portion 109 thereof that projects over the conveyor travel surface 80. This low profile allows the grippers 100 to travel through the operating areas 161 of each of the operating stations 160 without having to release the sheet 5 and then have another set of sheet engaging members direct the sheet 5 downstream upon its exit from the station 160, as in the prior machines and as previously discussed. Since the sheets 5 are traveling between rollers and counter-pressure bars in the stations for having adhesive and swatches applied thereto, as will be more fully described hereinafter, the low profile of the grippers 100 is desirable to allow them to pass through the operating stations 160 without requiring significant shifting of the nip or pressure bars so that they can fit therethrough.

Further, since the grippers 100 clamp onto the leading edge 6 of the sheet 5 and pull it though each of the operating stations 160, there is a much higher degree of control over the sheets 5 versus the control afforded by the feed fingers that pushed against the trailing edge of the sheets in prior machines, as discussed previously. This is especially important during high speed operations particularly where light sheet stock is being run, because air flow past the uncontrolled leading edges of the sheets and thereunder can create fluttering effects. Sheet fluttering or floating can cause the sheets to become slightly skewed with respect to the direction of travel and/or crumpling when fed to the operating areas. In either instance, undesirably high levels of sheet spoilage results, and if the sheets are damaged, time consuming and costly machine shut down can be required lowering overall machine productivity rates.

Gripping the leading edge 6 of the sheet 5 will keep the sheet 5 aligned during its downstream travel even at high operating speeds as the sheet 5 is positively clamped by the grippers 100. Accordingly, once the leading edge 6 of the sheet 5 is clamped by the grippers 100, it will stay in the same position relative thereto until the grippers 100 release the sheet 5. Thus, the need for side guides and the labor-intensive adjustment task they require when adjusting the machine to run sheets of differing sizes as has previously been described is substantially eliminated. In addition, the clamped or positively gripped leading edge 6 will not flutter even when being pulled at high speeds downstream by the conveyor. It has been found that by way of the present apparatus 1 and method, swatch bearing sheets 5 can be produced at much high production rates with significantly lower amounts of spoiled sheets. By way of example, prior machines, such as disclosed in U.S. Pat. No. 4,061,521, are capable of producing about 4500 swatch bearing sheets per hour. The apparatus 1 and method of the present invention allow swatch bearing sheets 5 to be produced at a rate of about 6000 sheets per hour.

In a preferred embodiment of the invention, a plurality of sheets 5 are arranged in a shingle-like fashion in a stack on an inclined sheet feed hopper 11, as illustrated in FIGS. 3–6. Disposed below the inclined sheet feed hopper 11 are indexing 14 and feed portions 15 of the feeding station 10. The combined use and arrangement of the inclined sheet feed hopper 11 and the indexing 14 and feed portions 15 of the feeding station 10 allow for additional stacks of sheets 5 to be placed on the inclined sheet feed hopper 11 without disrupting the flow of sheets 5 on the indexing 14 and feed portions 15 of the feeding station 10. This allows for continuous feeding of sheets 5. Sheets 5 from the stack of sheets 5 on the inclined sheet feed hopper 11 are moved to the indexing portion 14 of the feeding station 10 by a plurality of belts 16. As the sheets 5 are moved to the indexing portion 14 of the feeding station 10, individual sheets 5 are separated from the stack of sheets 5 such that each sheet 5 has an exposed leading edge 6.

Single sheets 5 are separated from one another on the indexing portion 14 of the feeding station 10 by a rotating suction wheel 20. The rotating suction wheel 20 is mounted to a rotating suction wheel shaft 21. Multiple holes 22 are disposed on the circumference of the rotating suction wheel 20. Suction 23 is applied to these holes 22 in a pulsed manner. As the rotating suction wheel 20 rotates, a suction hole 22 grabs the leading edge 6 of a sheet 5 and removes it from the stack of sheets 5. As the rotating suction wheel 20 continues its rotation, the suction 23 is removed, thereby releasing the sheet 5. One sheet 5 is removed from the stack of sheets 5 with every revolution of the rotating suction wheel 20.

After the sheet 5 has been removed from the stack of sheets 5 by the rotating suction wheel 20, the sheet 5 continues to the feed portion 15 of the feeding station 10. The feed portion 15 of the feeding station 10 comprises an inclined feed plate 30, as illustrated in FIG. 2. Multiple feed belts 31 are entrained about feed belt drive rollers 32 at each end of the feed plate 30. In this manner, each feed belt 31 includes upper and lower runs thereof with the upper run disposed on the top surface of the feed plate 30 and extending the length of the feed plate 30. The sheet 5 rides on the upper run of the feed belts 31 exposed on the top surface of the feed plate 30. The sheet 5 is moved forward on the downward incline of the feed plate 30 of the feed portion 15 of the feeding station 10 by the feed belts 31 from near the rotating suction wheel 20 to a feed end of the feed portion 15 of the feeding station 10 opposite the rotating suction wheel 20.

As the sheets 5 are by the feed belts 31 in the downstream direction of travel and over the feed plate 30 they are kept in contact with the upper runs of the feed belts 31 by multiple pairs of feed plate hold-down mechanisms 33. The hold-down mechanisms 33 reduce slippage between the feed belts 31 and the sheets 5 when they are in contact therewith and ensure the sheets 5 advance in the downstream direction of travel at the same rate as the upper runs of the feed belts 31. The feed plate hold-down mechanisms 33 each have an arm 34 with a feed wheel 35 rotatably attached thereto. The feed wheels 35 rest on the sheet 5 as the sheet 5 is fed along the feed plate 30 by the feed belts 31. The feed wheels 35 are freely rotatable. Near the upstream end of the feed portion 15 of the apparatus 1, the feed wheels 35 have rubber around their circumference to increase friction between the feed wheel 35 and the sheet 5 to maintain the sheet 5 in engagement on the feed belts 31 for downstream travel therewith.

As the sheets 5 are fed in the downstream direction of travel 3 over the feed plate 30 by the feed belts 31, the sheet 5 is moved laterally into the desired positional alignment for feeding of the sheet 5 to the gripper mechanisms 100. As the sheets 5 are removed from the stack of sheets 5 by the rotating suction wheel 20, the sheets 5 may be at slightly different lateral positions with respect to their location on the feed plate 30. By sliding each sheet 5 as it moves down the feed plate 30 against a spring member 43 attached to a guide rail 41 disposed on one side of the feed plate, each sheet 5 is thus positioned in the same location for feeding to the gripper mechanisms 100 thus ensuring that each sheet 5 has the same lateral alignment, necessary for accurate and consistent placement of the swatches 8 thereon by the apparatus 1.

More specifically, a sheet redirecting or alignment mechanism, generally designated with reference numeral 39, is provided that shifts the sheets 5 laterally as they travel downstream on the feed belts 31 so that the side edge 5*a* of the sheets 5 spaced from the side guide rail 41 rides close thereto when it reaches the downstream end of the feed plate 30. The sheet alignment mechanism 39 includes a pusher plate 42 that is disposed at the opposite side of the feed plate 30 so that as the pusher plate 42 is shifted laterally it will engage the sheets 5 at their side edges 5*b* opposite side edges 5*a* thereof. As will be discussed more fuller herein, the shifting of the pusher plate 42 is timed so that it is coordinated with the presence of a sheet 5 that is to be shifted thereby.

The lateral spacing between the guide rail 41 and pusher plate 42 is readily adjustable so that different widths of sheets 5 may be accommodated. To this end, the guide rail 41 is slidable in and can be secured to one or more adjustment slots 44 extending transversely across the feed plate 30. The adjustment of the sheet guide rail 41 is one of the few adjustments necessary to accommodate sheets 5 of differing widths in the apparatus 1, compared to the many adjustments necessitated by the multiple sets of travel surfaces and associated side sheet guides in prior machines discussed previously. This reduces the amount of set-up time for changing between differing widths of sheets 5 from about four hours, as in the previously described machines, to as little as five minutes in the apparatus 1 of the present invention.

The pusher plate 42 has a protrusion (not shown) that fits in the adjustment slot 44 proximate the sheet stop 50. The protrusion on the pusher plate 42 is configured to slide within the adjustment slot 44, thus causing the pusher plate to slide laterally across the feed plate 30 in a direction normal to the downstream travel direction. The pusher plate 42 is biased by a spring mechanism (not shown) away from the guide rail 41.

As each sheet 5 is advanced by the feed belts 31 down the feed plate 30, a cam wheel 48 causes shifting of an actuator, and specifically an actuator plate member 47 thereof via linkages therebetween, a portion 49 of which is shown that is operated by the cam wheel 48, and specifically cam member 143 thereon. The sliding of the plate member 47 is restricted by guide posts 46 that extend through guide slots 45 formed therein. The guide slots 45 extend obliquely with respect to the travel direction. The posts 46 cooperating with the oblique slots 45 cause the plate member 47 to slide in an oblique direction to the downstream travel direction upstream and towards the guide rail 41. The pusher plate 42 abuts against the side of the plate member 47 facing the guide rail 41. The rotation of the cam wheel 48 is coordinated with the indexing and advancement of sheets 5 by the rotating suction wheel 20 and the operating speed of the apparatus 1 by the common drive shaft 151, as illustrated schematically in FIG. 33. A cam member 143 is disposed on the circumferential surface of the cam wheel 48 to project radially outward therefrom. For every rotation of the cam wheel 48, the cam member 143 engages and then disengages the actuator mechanism portion 49. When the cam member 143 of the cam wheel 48 is in engagement with the actuator mechanism portion 49, the actuator mechanism portion 49 pushes the plate member 47 in a direction upstream and towards the guide rail 41. The plate member 47 urges the pusher plate 42 and the sheet 5 thereagainst towards the guide rail 41. The pusher plate 42 is restricted by the cooperating protrusion and the slot 44 to sliding only laterally across the feed plate 30. The guide rail 41 has a spring member 43 thereon facing the pusher plate 42. The spring member 43 absorbs or cushions the slight impact of the sheet 5 as it is pushed thereagainst so that the sheet 5 does not tend to rebound back oppositely to its pushed direction. Without the spring member 43 to prevent the rebounding of the sheet 5, each sheet 5 may not be consistently positioned relative to the guide rail 41 due to the aforesaid impact and rebounding action. As the cam member 43 of the cam wheel 48 disengages from the actuator mechanism portion 49 due to continued rotation of the cam wheel 48, the actuator mechanism portion 49 pulls the plate member 47 back to its original position, allowing the pusher plate 42 to also return to its original position, where the process is repeated again for the next sheet 5 advancing along the surface of the feed plate 30.

At the end of the feed portion 15 of the feeding station 10 opposite the rotating suction wheel 20 is a sheet stop 50. The sheet stop 50 includes a stop bar 51 with two protruding stop members 52 attached thereon. An end of the stop members 52 protrudes above the surface of the feed plate 30. As a sheet 5 is fed by the feed belts 31 to the end of the feed plate 30 opposite the rotating suction wheel 20, the leading edge 6 of the sheet 5 abuts against the stop members 52 of the sheet stop 50. Near the end of the feed plate 30 opposite the rotating suction wheel 20, the feed wheels 35 have multiple bristles around their circumferential edges. The bristles maintain the sheets 5 in contact with the feed belts 31 when the sheets 5 are substantially under the feed wheels 35 with bristles thereon so that the sheet 5 may advance downstream, but the give inherent in the bristles avoids their pushing the trailing edge 9 of the sheet 5 when the sheet 5 is in abutment with the sheet stops 52 so as to cause bending and/or crumpling of the sheet 5 against the sheet stops 52.

At the end of the feed portion 15 of the feeding station 10 opposite the rotating suction wheel 20 and above the feed portion 15 of the feeding station 10 is a suction feeder 60. The suction feeder 60 comprises multiple suction heads 61 mounted on a suction feeder shaft 62. As the sheet 5 is moved by the feed belts 31 and between the guide rail 41 and the pusher plate 42 to the suction feeder 60, suction 63 applied to the suction heads 61 of the suction feeder 60 draw the leading edge 6 of the sheet 5 upwardly into secure engagement therewith. The suction feeder shaft 62 then pivots the suction heads 61 and the leading edge 6 of the sheet 5 up and away from the top surface of the feed belts 31 on the feed plate 30. As the suction feeder shaft 62 pivots the suction heads 61 and the leading edge 6 of the sheet 5 up and away from the top surface of the feed plate 30, the stop bar 51 pivots the stop members 52 below the top surface of the feed plate 30. The timing of the pivoting of the stop members 52 below the surface of the feed plate 30 and the pivoting of the suction heads 61 toward the forward edge of the feed plate 30 is coordinated by arrangement of respective cams (not shown), each mechanically operable off of the common drive shaft 151, referenced schematically in FIG. 33.

Figure 16:
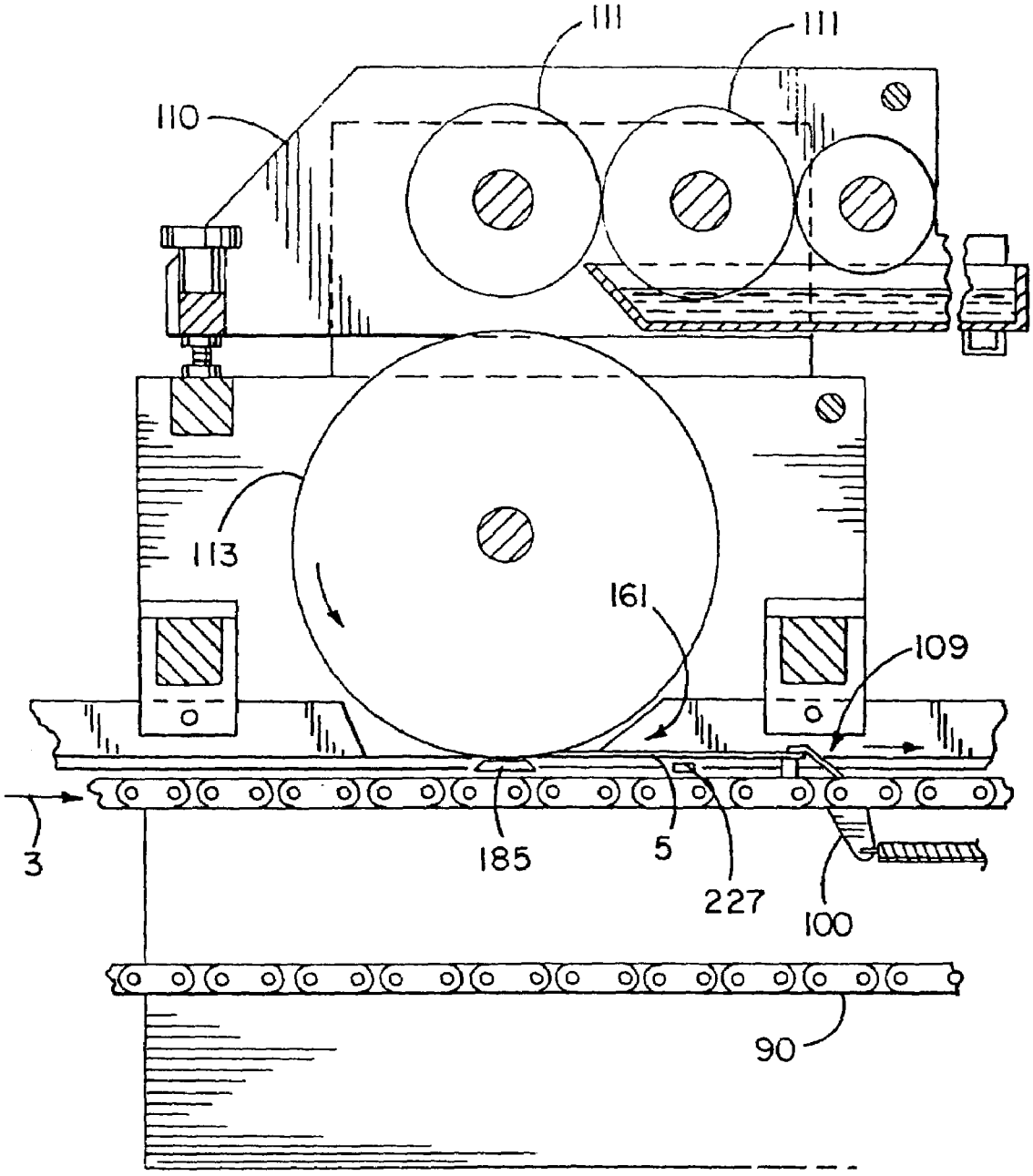
FIG. 16 is an elevational view partially in section of the adhesive applying station of FIG. 1.

The adhesive applying 110 and the swatch applying stations 120 are disposed between travel surfaces 80, as illustrated in FIG. 16. The travel surfaces 80 are disposed above the upper run of the conveyor drive chains 90 to provide a flat surface for the sheets 5 to slide upon as they are pulled in the downstream direction by the gripper mechanisms 100. The travel surfaces 80 may comprise plates 80 with teflon coatings to facilitate sheets 5 sliding thereon. There are one or more pairs of longitudinal slots 81 that run uninterrupted from the upstream end of the travel plates 80 to the downstream end of the travel plates 80.

Disposed beneath and extending partially in front of the start of the travel plates 80 are pairs of idler sprockets 85 mounted to an idler shaft 86. Disposed beneath the end of the travel plates 80 are pairs of drive sprockets 87 mounted to a drive shaft 88. Each one of the pairs of idler sprockets 85 is aligned with one of the pairs of drive sprockets 87 in the downstream direction. Each of the pairs of idler sprockets 85 and drive sprockets 87 have sprocket teeth 89 extending radially from their circumferential edge.

Pairs of endless chains 90 extend longitudinally between pairs of aligned idler sprockets 85 and drive sprockets 87, thereby providing a continuous chain 90 extending the entire length of the arrangement of operating stations 160 and eliminating the need for multiple sets of chains to span the length of the arrangement of operating stations 160 as in prior machines described hereinabove. Typically, these chains 90 are of a heavy duty steel material. The chains 90 are of standard construction and comprise multiple chain links 91. The links 91 have two side plates 98 spaced a distance apart with two pins 99*a* extending through cylindrical through holes 99*b* and connecting the plates 98 to each other. Each one of the pins 99*a* also connects each link 91 to adjacent links 91 in the chain 90.

Figure 28:
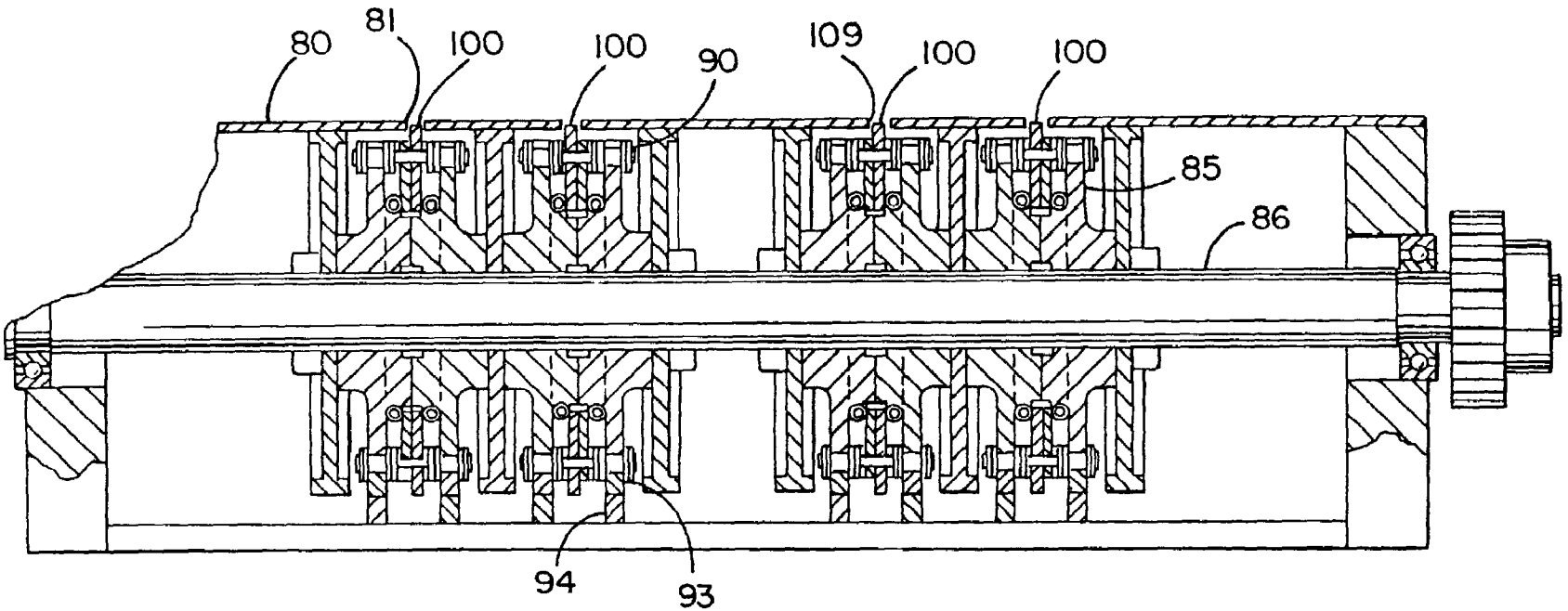
FIG. 28 is a cross-sectional view of the apparatus taken along line 28—28 of FIG. 1 showing the chain with gripper mechanisms thereon protruding through slots in the travel plates.

Because the chains 90 extend the entire length of the arrangement of operating stations 160, the weight of the chains 90 can cause the chains 90 to sag between the sprockets 85 and 87. Thus, plastic runners 93 disposed on top of longitudinally extending support members 94 are provided for the pins 99*a* of the chains 90 to run upon between the sprockets 85 and 87 to prevent the chains 90 from sagging therebetween, as illustrated in FIG. 28. The plastic runners 93 present a low-friction surface for the chains 90 to run on between the sprockets 85 and 87 with the support members 94 serving to provide the necessary support to avoid sagging of the long conveyor chains 90, and the attendant problems created thereby, such as having the gripper mechanisms 100 possibly damage the sheets 5 by pulling them downwardly into the slots 81 in which the gripper mechanisms 100 travel.

Cam discs 70 are mounted on the drive shaft 88 and idler shaft 86. The cam discs 70 have a generally key-shaped profile, comprising a main annular body portion 70*a* and an adjustment arm 70*b* extending therefrom. Each cam disc 70 has a cylindrical through hole 78 in the body portion 70*a* thereof and a bushing 77 press fit or otherwise secured in the body through hole 78. The bushings 77 fit around the drive shaft 88 and idler shaft 86 such that the drive and idler shafts 88 and 86 freely rotate with respect to the cam discs 70. The cam discs 70 each have a cam adjustment slot 76 at the end of the adjustment arm 70*b* that fits partially around a cam adjustment bar 75.

Attached to the cam discs 70 are generally wedge-shaped cam members 71. The cam members 71 have a rear cam surface 72, intermediate cam surface portions 73*a* and 73*b*, and a forward cam surface 74. The elevation of the cam adjustment bar 75 can be raised and lowered thereby changing the elevation of the cam adjustment slot 76 and causing the cam discs 70 to rotate with respect to the shafts 86 and 88, thus shifting the circumferential position of the cam members 71 relative to the shaft 88 or 86 on which it is mounted, as illustrated in FIG. 10. The elevation of the cam adjustment bar 75 is changed by the rotation of screws 191 threaded through the ends 192 thereof. The ends of the screws 191 rest on portions of the frame 190 of the apparatus. As the screws 191 on each end 192 of the cam adjustment bar 75 are rotated, the position of the cam adjustment bar 75 with respect to the screws 191 is changed, thus changing the circumferential position of the cam members 71 disposed on the cam discs 70. Rotation of the screws 191 and subsequent adjustment of the cam discs 70 allows for the precise positioning of the circumferential position of the cam members 71 thereon. The position of the cam members 71 controls the position of the gripper mechanisms 100 when they shift to their open positions for gripping a sheet 5, as at the infeed of the apparatus 1, or for removal of a sheet 5 therefrom, as at the outfeed of the apparatus 1.

Figures 4, 7, 7A:
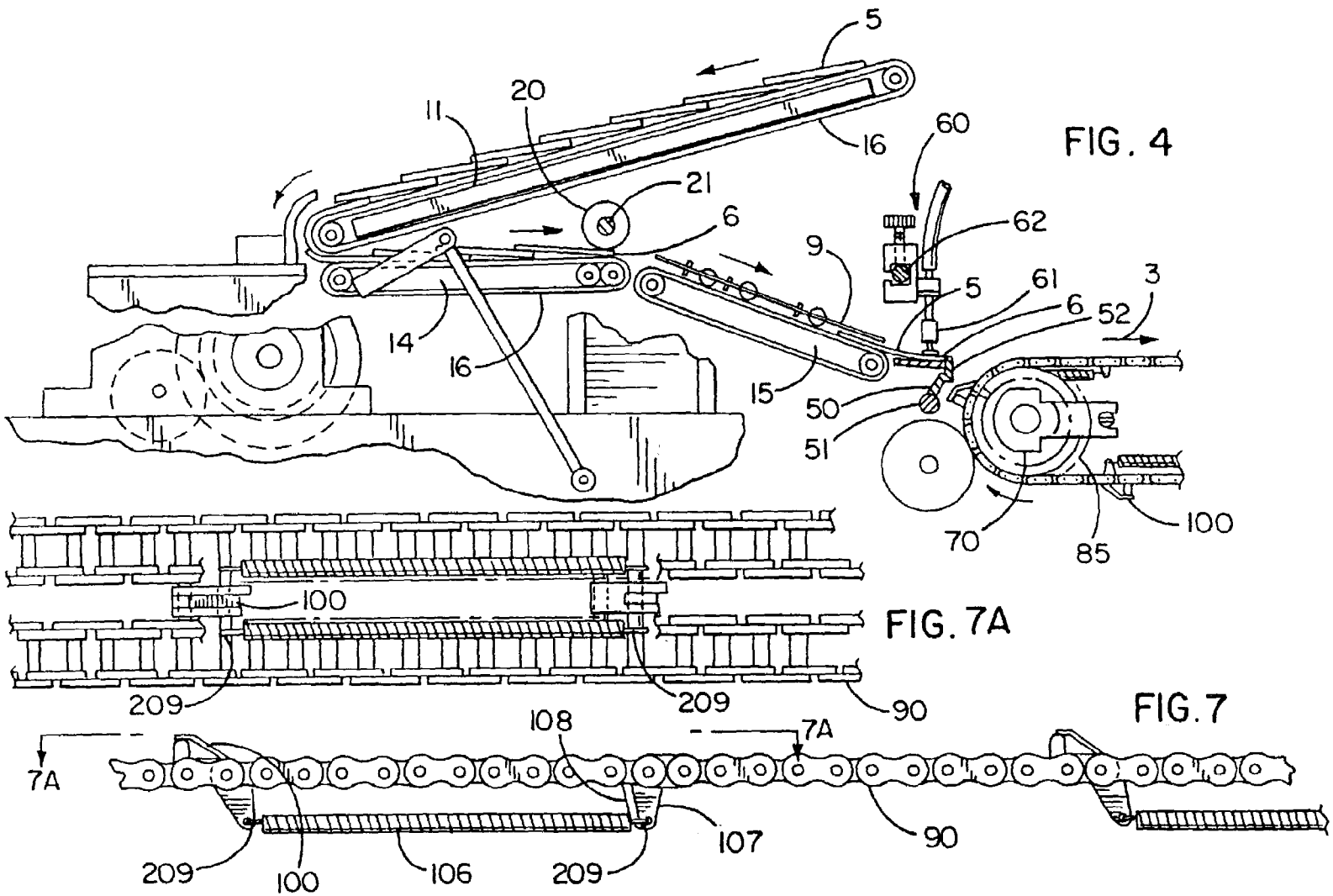
FIG. 4 is an enlarged elevation view of the inclined sheet feed hopper, indexing portion, and feed portion of the feeding station of FIG. 3 showing a sheet abutting against the sheet stop, the suction feeder in its first position without suction applied thereto, and the gripper mechanism in its closed position.
FIG. 7 is an elevation view of the endless chain of FIG. 1 with the gripper mechanisms in their closed positions.
FIG. 7A is a plan view of the endless chain of FIG. 7.

Attached to the endless chains 90 are multiple gripper mechanisms 100 for pulling sheets 5 in the downstream direction of travel through the operating areas 161 of the operating stations 160, as illustrated in FIGS. 7, 7A, 9 and 11–15. The gripper mechanisms 100 are pivotably mounted to cress links 95 that extend between pairs of chains 90, as illustrated in FIG. 7A. The gripper mechanisms 100 are aligned with and protrude upward through longitudinal slots 81 formed in the travel surfaces 80 and extending in the downstream direction of travel, as illustrated in FIG. 28.

Figure 14:
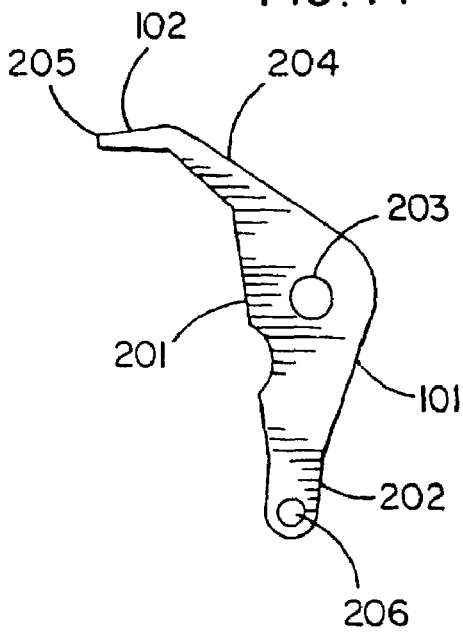
FIG. 14 is an elevation view of the upper jaw of the gripper mechanism of FIG. 9.
Figure 15:
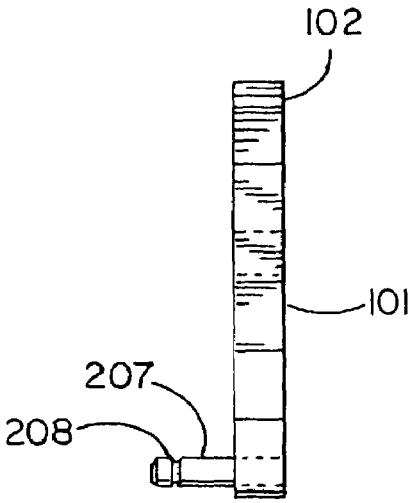
FIG. 15 is an elevation view of the upper jaw of the gripper mechanism of FIG. 9.

The gripper mechanisms include pivotal members with a clamping or upper jaw member 101 of the gripper mechanism 100 having a body portion 201 with an end having a gripper arm 102 extending substantially rearward therefrom and another end having a leg 202 extending downward therefrom, as best seen in FIG. 14. The clamping member 101 is aligned with the cam member 71 so that it engages therewith, as will be discussed more fully hereinafter. The body 201 has a cylindrical through aperture 203 for receiving the forward pin 96 of the chain cross link 95 therethrough. The gripper arm 102 includes an upper arm portion 204 sloping upward and rearward from the leg 202 and a distal clamping portion 205 extending rearward from the upper arm portion 204. Preferably, the upper arm portion 204, and in particular the clamping portion 205 thereof, are very narrow or thin in cross section as compared to the remainder of the clamping member 101, as can be seen in FIG. 14. This assists in keeping the overall profile or distance the gripper mechanisms 100 project above the travel surfaces 80 to a minimum. The slope of the upper arm portion 204 facilitates the gripper mechanism 100 passing through the operating areas 161 of the operating stations 160 without catching therein because she slope presents a smooth surface 204*a* without protrusions that might catch in the operating areas 161. Also, the incline of the sloped surface 204*a* is configured such that if it contacts a roller 113 or 182 in an operating area 161, the roller will progressively urge the gripper downward against the counter roller or bar 180 or 185 therebelow to allow it to pass through the operating area 161 without sudden hang-ups or the like.

The leg 202 has a cylindrical aperture 206 for receiving a spring post 207 press fit therein. The spring post 207 projects out laterally from the upper jaw 101 when received in the cylindrical through aperture 206 formed in the leg 202. The spring post 207 has a circumferential groove 208 formed thereabout for receiving a loop 209 at the end of a spring 106, for purposes that will be described more fully hereinbelow. The circumferential groove 206 helps to maintain the loop 209 of the spring 106 in position with respect to the spring post 207.

Figure 11:
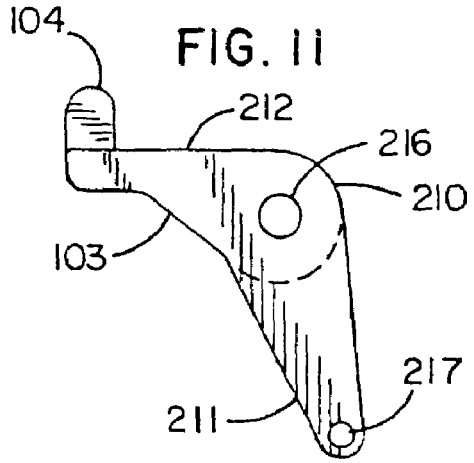
FIG. 11 is an elevation view of the lower jaw of the gripper mechanism of FIG. 9.
Figure 12:
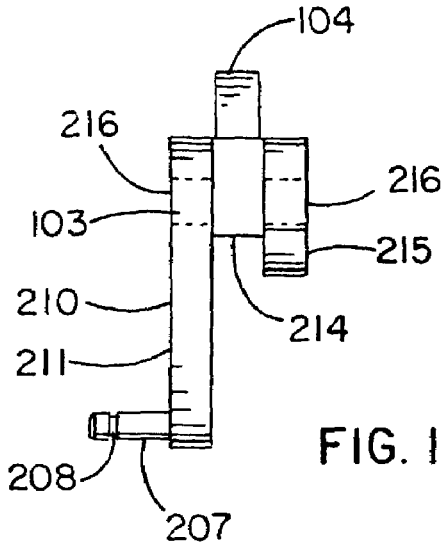
FIG. 12 is an elevation view of the lower jaw of the gripper mechanism of FIG. 9.
Figure 13:
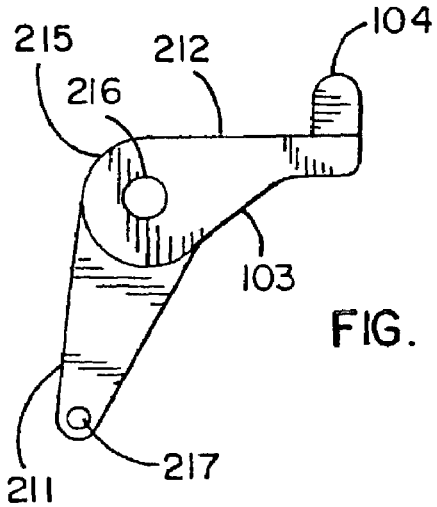
FIG. 13 is an elevation view of the lower jaw of the gripper mechanism of FIG. 9.

A support or lower jaw member 103 of the gripper mechanism 100 has a body portion 210 with a leg portion 211 extending downward and an arm portion 212 extending rearward therefrom, as best seen in FIG. 11. A slot 214 separates the leg portion 211 from an opposite side portion 215. The slot 214 is sized so that the width of the body 201 of the clamping member 101 fits therein. The body and side portions 210 and 215 of the lower jaw 103 have aligned cylindrical through apertures 216 for receiving the forward pin 96 of the cross link 95. The upper jaw 101 is pivotally attached in the slot 214 between the body and side portions 210 and 215 of the lower jaw 103 with the pin 96 extending through the aligned apertures 216 of the body and side portions 210 and 215 and the through aperture 203 of the clamping member body 201 disposed therebetween.

The arm portion 212 has a small gripper tab 104 extending upward therefrom for providing an engagement surface against which the distal clamping portion 205 of the upper jaw 101 clamps a sheet 5 therebetween. The leg portion 211 of the lower jaw 103 has a cylindrical through hole 217 for receiving a spring post 207 press fit therein in a similar manner as described above for the spring post 207 of the upper jaw 101.

It has been found particularly where there are large differences in operating speeds of the apparatus 1 herein that the gripper mechanisms 100 may clamp on the sheets 5 at different positions relative to the leading edge 6 thereof. Even slight variations in the positions of the sheets 5 clamped between the upper and lower jaws 101 and 103 of the gripper mechanisms 100 can result in undesirable imprecision in swatch 8 placement on the sheets 5. To this end, it is preferred that a sheet stop 178 be provided on the arm portion 212 of the lower jaw 103 disposed rearward, toward the body portion 210 of the lower jaw 103, of the gripper tab 104, as seen in FIG. 9. The sheet stop 178 provides a positive register for the leading edges 6 of the sheets 5. As the sheets 5 are fed between the upper and lower jaws 101 and 103 of the gripper mechanisms 100 in their open positions, the leading edges 6 of each of the sheets 5 abut against the sheet stop 178, thereby ensuring that the leading edges 6 of the sheets 5 are held in the same precise positions when the gripper mechanisms 100 clamp the sheets 5 for pulling them through the operating stations 160.

The sheet stop 178 extends upward from its mounting in a recessed hole 176 in the arm portion 212. The sheet stop 178 includes a sleeve 172 with a longitudinal slot 177 formed therein. The slot 177 has upper and lower ends 177*a* and 177*b* defining the limits of travel for sheet stop member 171. A spring 175 sits in the bottom of the sleeve 172. The sheet stop member 171 is slidable within the sleeve 172 and is biased upward so that an upper portion 171*a* of the member 171 projects out from the sleeve 172 by urging of the spring 175. The sheet stop member 171 has a pin 174 extending perpendicularly therethrough with respect to the longitudinal axis thereof. The pin 174 slides within the slot 177 of the sleeve 172 to prevent the sheet stop member 171 from extending completely out of the sleeve 172. As a sheet 5 is inserted between the jaws 101 and 103 in their open position, the leading edge 6 of the sheet 5 abuts against the upper portion 171*a* of the sheet stop member 171 protruding from the sleeve 172. The distal clamping portion 205 of the upper jaw 101 then closes on the gripper tab 104 of the lower jaw 103 clamping the sheet 5 therebetween and pressing the sheet stop member 171 into the sleeve 172 against the bias force of the spring 175. In this manner the sheet stop 178 provides a register for the sheets 5, ensuring that the sheets 5 are fed into the same position between the gripper jaws 101 and 103 irrespective of the operating speed of the apparatus 1.

The springs 106 extend from the spring posts 207 on each of the legs 202 and 211 of the upper jaw and lower jaw 101 and 103 forward with respect to the direction of travel 3 of the chain 90 to corresponding spring posts 207 on spring attachment legs 107 and 108 extending downward from between parallel pairs of endless chains 90. The spring 106 connected to the leg 211 of the lower jaw 103 pulls the leg 211 forward, pivoting the body 210 about the forward pin 96 of the cross link 95 and thereby biasing the bottom of the arm 212 of the lower jaw 103 against the rearward pin 97 of the cross link 95. The spring 106 connected to the leg 202 of the upper jaw 101 pulls the leg 202 forward, pivoting the body 201 about the forward pin 96 of the cross link 95 and thereby biasing the distal clamping portion 205 of the upper jaw 101 toward the gripper tab 104 of the lower jaw 103. The tensions of the springs 106 are chosen so as to ensure that the springs 106 exert sufficient bias to maintain the arm 212 of the lower jaw 103 against the rearward pin 97 of the cross link 95 and the upper jaw 101 against the lower jaw 103, even as the gripper mechanisms 100 travel around the sprockets 85 and 87 and the distance between the legs 202 and 211 of the upper and lower jaws 101 and 103 and the corresponding spring attachment legs 107 and 108 changes and is shortened.

As the pairs of endless chains 90 with attached gripper mechanisms 100 travel over the cam members 71 on the cam discs 70, the grippers 100 move from a closed position to an open position and back to the closed position via contact with the cam member 71, as sequentially illustrated in FIGS. 8A–8F. The cam member 71 has a rearward surface 72 that extends upward in a substantially normal direction relative to the annular periphery of the body portion 70*a* of the cam disc 70 to a cam surface 73. In this manner, the leg 202 of the clamping member 101 engages the surface 72 and stops its downstream travel, thereby causing the clamping member 101 to pivot with respect to the clamping member 103 with continued downstream travel of the gripper mechanism 100.

The cam surface 73 is contoured to generally extend circumferentially about the annular periphery of the cam disc 70 for progressively changing the spacing, designated S, between the clamping portion 205 of the gripper arm 102 and the upstanding tab 104 of the clamping member 103. In the preferred and illustrated form, the cam surface 73 preferably includes two flat surface portions 73*a* and 73*b*. The distance from the periphery of the cam disc 70 to the flat surfaces 73*a* and 73*b* of the cam surface 73 controls the amount of pivoting of the clamping member 101 as its leg 202 rides on the surface 72 and thus the spacing, S, between the upper and lower jaws 101 and 103 of the gripper mechanism 100 in its open position. The flat cam surface 73*b* joins the forward surface 74 at a corner therebetween from which the surface 74 extends down to the periphery of the cam disc 70. The distance from the flat cam surface 73*b* to the periphery of the cam disc 70 gradually becomes smaller or tapers from where the flat surface 73*a* joins the flat surface 73*b* to where the surface 74 joins the flat surface 73*b*. This taper allows for a gradual decrease in the spacing S as the leg 202 of the clamping member 101 rides on the surface 73*b*.

The profile of the cam member 71, and in particular the surface portions 73*a* and 73*b* thereof, is chosen to control proper clamping of the sheet 5 between the jaws 101 and 103 of the gripper mechanism 100. For example, the lengths of the flat surfaces 73*a* and 73*b* of the cam surfaces 73 control the amount of time the gripper mechanisms 100 remain in their open positions as the legs 202 of the lower jaws 101 passes thereover. The cam members 71 proximate the infeed have a longer cam surface 73 to facilitate insertion of a sheet 5 between the open gripper jaws 101 and 103. The cam members proximate the outfeed have a relatively shorter cam surface 73 because the sheets 5 are quickly removed from between the open gripper jaws 101 and 103, as will be described more fully hereinafter.

Figure 8A:
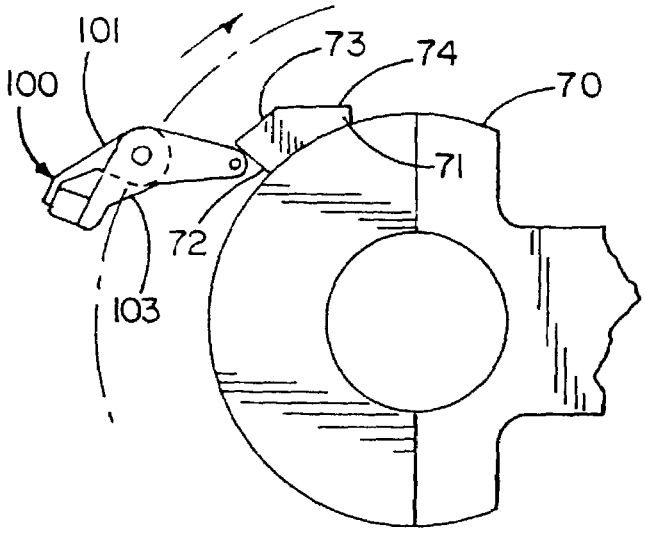
FIG. 8A is an elevation view of the upper and lower jaws of the gripper mechanism of FIG. 3 in its closed position immediately before contact with the rear cam surface of the cam member.
Figure 8B:
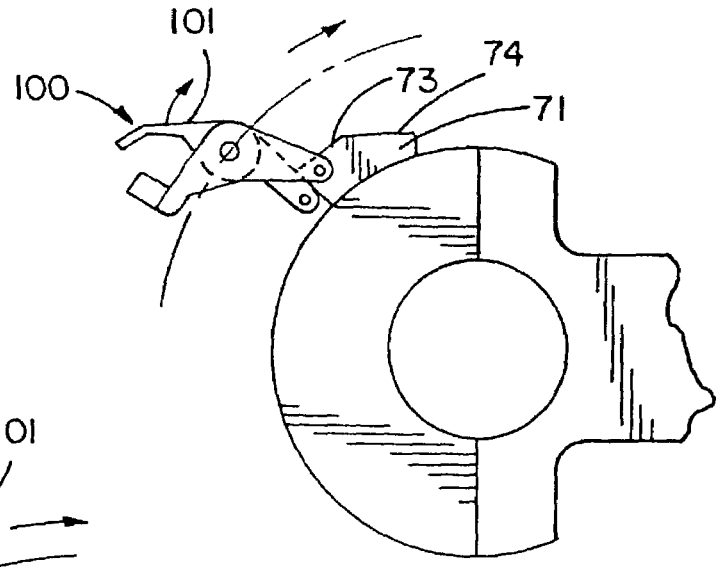
FIG. 8B is an elevation view of the upper and lower jaws of the gripper mechanism of FIG. 3 in between its open position and closed position immediately after contact with the rear cam surface of the cam member.
Figure 8C:
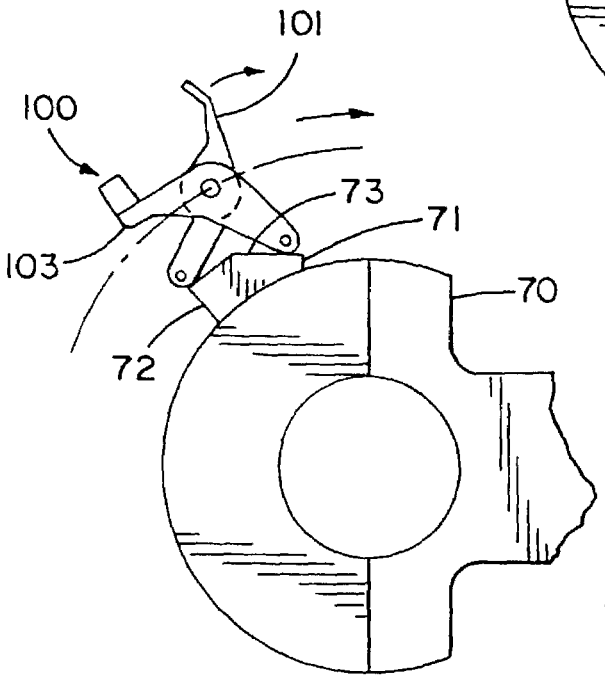
FIG. 8C is an elevation view of the upper and lower jaws of the gripper mechanism of FIG. 3 in its open position during contact with the cam surface of the cam member.

Before contacting the cam member 71, the gripper mechanism 100 is in its closed position wherein the clamping portion 205 of the upper jaw 101 presses down on the gripper tab 104 of the lower jaw 103 as illustrated in FIG. 8A, by the biasing force provided by the spring 106. As the endless chains 90 with attached gripper mechanisms 100 travel over the sprockets 85 or 87, the leg 202 of the upper jaw 101 contacts the rear cam surface 72 of the cam member 71, as illustrated in FIG. 8B. The endless chains so and the gripper mechanism 100 continue to travel around the sprockets 85 or 87 while the gripper mechanism 100 is moved to its open position by the rear cam surface 72 contacting the leg 202 of the upper jaw 101, as illustrated in FIG. 8C. Accordingly, this engagement with the rear cam surface 72 arrests downstream travel of the leg 202 of the upper jaw 101 so that the upper jaw 101 pivots open with respect to the lower jaw 103 against the bias provided by the spring 106 as the jaw 101 continues its travel about the idler sprocket 85. The leg 202 of the upper jaw 101 then is raised along the height of the surface 72 until it rides over the corner between it and the cam surface 73. The leg 202 then traverses surface 73.

Figure 8D:
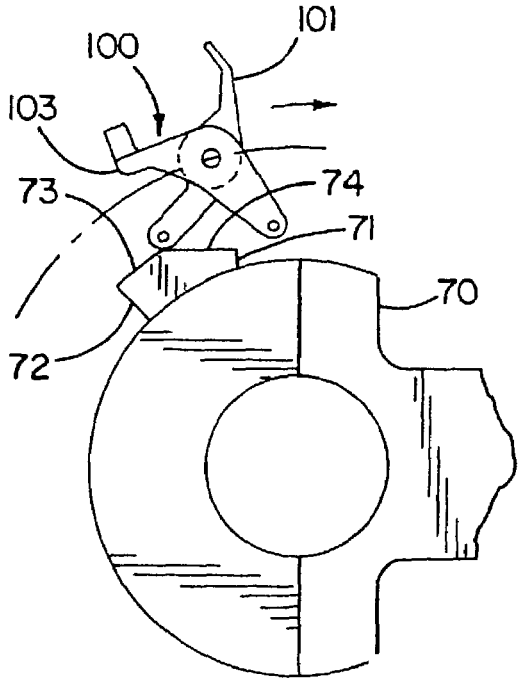
FIG. 8D is an elevation view of the upper and lower jaws of the gripper mechanism of FIG. 3 in its open position during contact with the cam surface of the cam member.
Figure 8E:
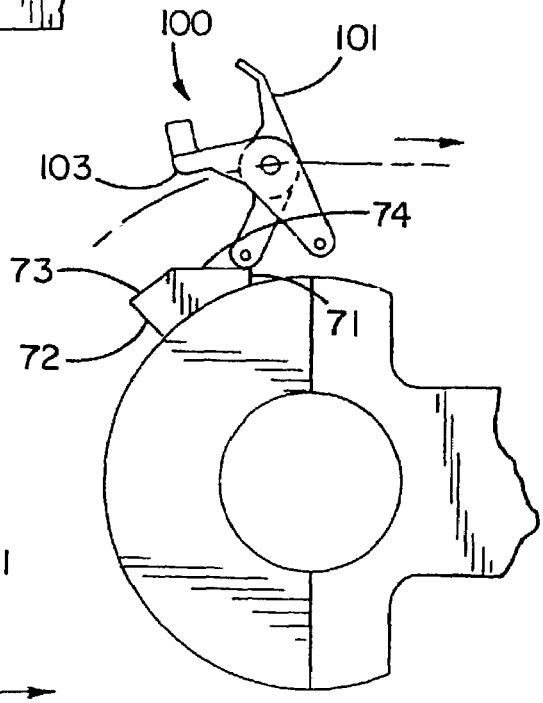
FIG. 8E is an elevation view of the upper and lower jaws of the gripper mechanism of FIG. 3 in between its closed position and open position during contact with the forward cam surface of the cam member.
Figure 8F:
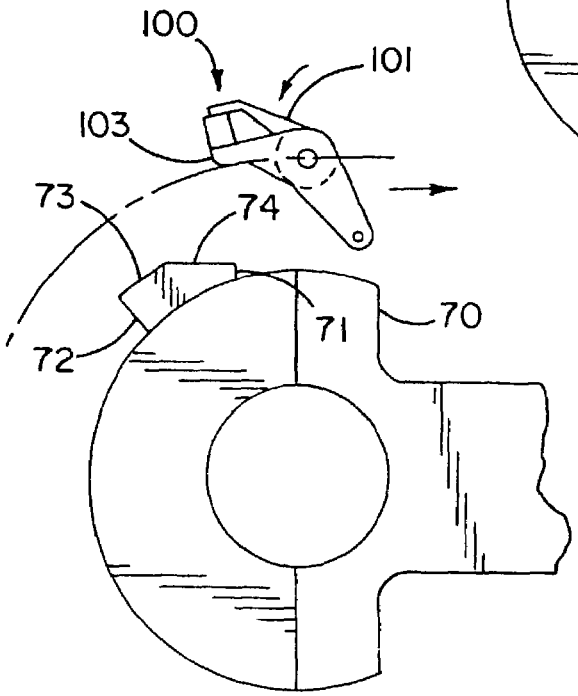
FIG. 8F is an elevation view of the upper and lower jaws of the gripper mechanism of FIG. 3 in its closed position after contact with the cam member.

The cam surface portion 73*a* is configured to keep the upper jaw 101 pivoted against the biasing force of the spring 106, thereby substantially maintaining the gripper mechanism 100 in its open position with the maximum spacing S to allow for proper insertion of a sheet 5 therebetween, as illustrated in FIG. 8D. In this regard, the cam surface portion 73*a* maintains a substantially constant radius following the periphery of the disc 70 with slight variations due to its flat configuration. The height of the cam surface 72 and the length of the leg 202 are selected so that the travel of the leg 202 of the upper jaw 101 is initially arrested by the cam surface 72. The leg 202 then pivots relative to the lower jaw 103 about the forward pin 96 of the cross link 95. The leg 202 pivots until the end of the leg 202 is above the corner formed at the juncture between the rearward cam surface 72 and the cam surface 73. The leg 202 then rides on the cam surface 73 which maintains the upper jaw 101 pivoted against the bias force provided by the spring 106. When the leg 202 rides on the cam surface 73*a*, the spacing S between the open jaws 101 and 103 is at a maximum. The leg 202 then rides on cam surface portion 73*b*, and the spacing S between the open jaws 101 and 103 gradually decreases. The spacing S decreases when the leg 202 is riding on the surface portion 73*b* because the elevation of the surface portion 73*b* above the periphery of the cam disc 70 decreases from the juncture with the surface portion 73*a* to the juncture with the forward cam surface 74. When the leg 202 of the upper jaw 101 has passed the corner formed by the juncture between the forward cam surface 74 and the cam surface 73, the bias provided by the spring 106 returns the gripper mechanism 100 to its closed position because the leg 202 is no longer prevented from rotation about the forward pin 96 of the cross link 95 relative to the lower jaw 103 by the cam surface portions 73*a* and 73*b*, as illustrated in FIG. 8E. Once the gripper mechanism 100 clears the corner between the cam surface portion 73*b* and the forward surface 74, the upper jaw 101 has dropped off the cam member 71 and is no longer constrained from pivoting to its closed position thereby thus causing the upper jaw 101 to snap shut onto the lower jaw 103 under the influence of the bias provided by the spring 106 with the clamping portion 205 of the upper jaw 101 pressing down on the gripper tab 104 of the lower jaw 103, as illustrated in FIG. 8F, and the sheet 5 properly inserted therebetween.

The cam members 71 proximate the infeed have profiles configured so that the gripper mechanisms 100 shift to their open positions with maximum spacing between the gripper members 101 and 103 very quickly upon the grippers 100 encountering the cam members 71. Each cam member 71 is profiled so that this maximum open position is maintained for a sufficient duration to allow a sheet 5 to be readily fed into the relatively large space between the gripper members 101 and 103, thereby minimizing the chance for misfeeds to occur.

Once the sheet 5 is properly fed between the open gripper members 101 and 103, the profile of each cam member 71 is programmed to cause the gripper members 100 to shift to reduce the spacing therebetween for minimizing the impact force against the sheet 5 when clamped onto by the gripper members 101 and 103. Finally, with the gripper members 101 and 103 at their minimum spacing, the car members 71 are configured to allow the grippers mechanisms 100 to clamp onto the sheet 5 for securely pulling downstream and through the various operating stations 160. By causing clamping of the gripper members 101 and 103 on the sheet 5 from a minimum spacing, the impact force of the gripper members 101 and 103 on the sheet 5 will be lowered and the time to clamp will be lessened, thereby increasing the accuracy in terms of consistently gripping each sheet 5 at a predetermined location adjacent its leading edge 6. As is apparent, the cams 71 are configured to allow the sheets to be fed to a wide space between the gripper members 101 and 103 while minimizing the chance that undesirable damage to the sheets 5 will occur upon clamping of the gripper members 101 and 103 thereon by progressively closing them prior to the clamping action on the sheets 5.

The cam members 71 proximate the outfeed are configured so that the gripper members 101 and 103 shift to their maximum spacing between each other in the open position very quickly upon the gripper mechanisms 100 encountering the cam members 71, as illustrated in FIGS. 21–25. When the gripper mechanisms 100 are in their open position, the sheets 5 are removed from therein by the disengagement wheels 131 protruding above the surface of the travel plates 80, as will be described more fully hereinbelow. The profile of each cam member 71 proximate the outfeed allows the gripper mechanisms 100 to quickly return to their closed positions once the sheet 5 has been removed from therein by the disengagement wheels 131.

Located along the travel plates 80 is an adhesive applying station 110 and one or more swatch applying stations 120. Also located along the travel plates 80 and after the adhesive applying station 110 and the swatch applying stations 120 are a disengaging station 130 and a pressing station 140. Located below the travel plates 80 and the disengaging station 130 are the drive sprockets 87.

At the adhesive applying station 110 one or more adhesive or glue spots 7 are applied to the sheet 5. Adhesive or glue in liquid form is deposited on intake rollers 111. The intake rollers 111 are arranged so that their axes of rotation extend parallel to each other and normal to the direction of travel 3 of the endless chain 90. As the adhesive or glue is deposited on the intake rollers 111, the intake rollers 111 spread a thin coating of the adhesive or glue on application pads 112 on an application roller 113, as illustrated in FIG. 17. The application pads 112 are typically formed of rubber. The application pads 112 are spaced apart on the application roller 113 so that as the sheet 5 is pulled through the adhesive applying station 110 by the gripper mechanisms 100, on adhesive or glue spot 7 is applied to each location where a swatch 8 is to be applied. The application roller 113 rotates one revolution for each sheet 5 fed through the adhesive applying station 110.

At each of the swatch applying stations 120 a row of swatches 8 is applied to the sheet 5, as illustrated in FIGS. 19 and 18, respectively. Multiple swatch applying stations 120 may be set up in succession for each row of swatches 8 to be deposited on the sheet 5. The row may contain one or more individual swatches 8. Rolls 121 of color ribbons 123 are disposed on a roll bar 122. The rolls 121 may freely totate about the roll bar 122. Typically, each roll 121 will be of a different color ribbon 123. The swatch roller 124 has a severing blade 125 disposed parallel to the axis of rotation thereof. As the sheet 5 is pulled through the swatch applying station 120, the swatch roller 124 unwinds each roll 121 of color ribbon 123. As the severing blade 125 of the swatch roller 124 contacts the severing bar 128, an end of each color ribbon 123 is severed into a swatch 8. Suction holes 126 are disposed on the swatch roller 124. Each severed swatch 8 continues to rotate on the swatch roller 124, held in place by suction 127 applied through the suction holes 126, until brought into contact with the suction strip 129 on the transfer roller 182. Suction then adheres the swatch 8 the suction strip 129 as the transfer roller 182 rotates the suction strip 129 against the sheet 5 thereunder. A rocker bar 180 disposed between a gap in the travel plates 80 directly under the axis of the transfer roller 182 rocks downward as the swatch 8 is applied to the adhesive or glue spots 7 on the sheet 5. The swatches 8 then adhere to the adhesive or glue spot 7 on the sheet 5 as the sheet 5 is pulled by the gripper mechanisms 100 past the swatch applying station 120.

Figure 20:
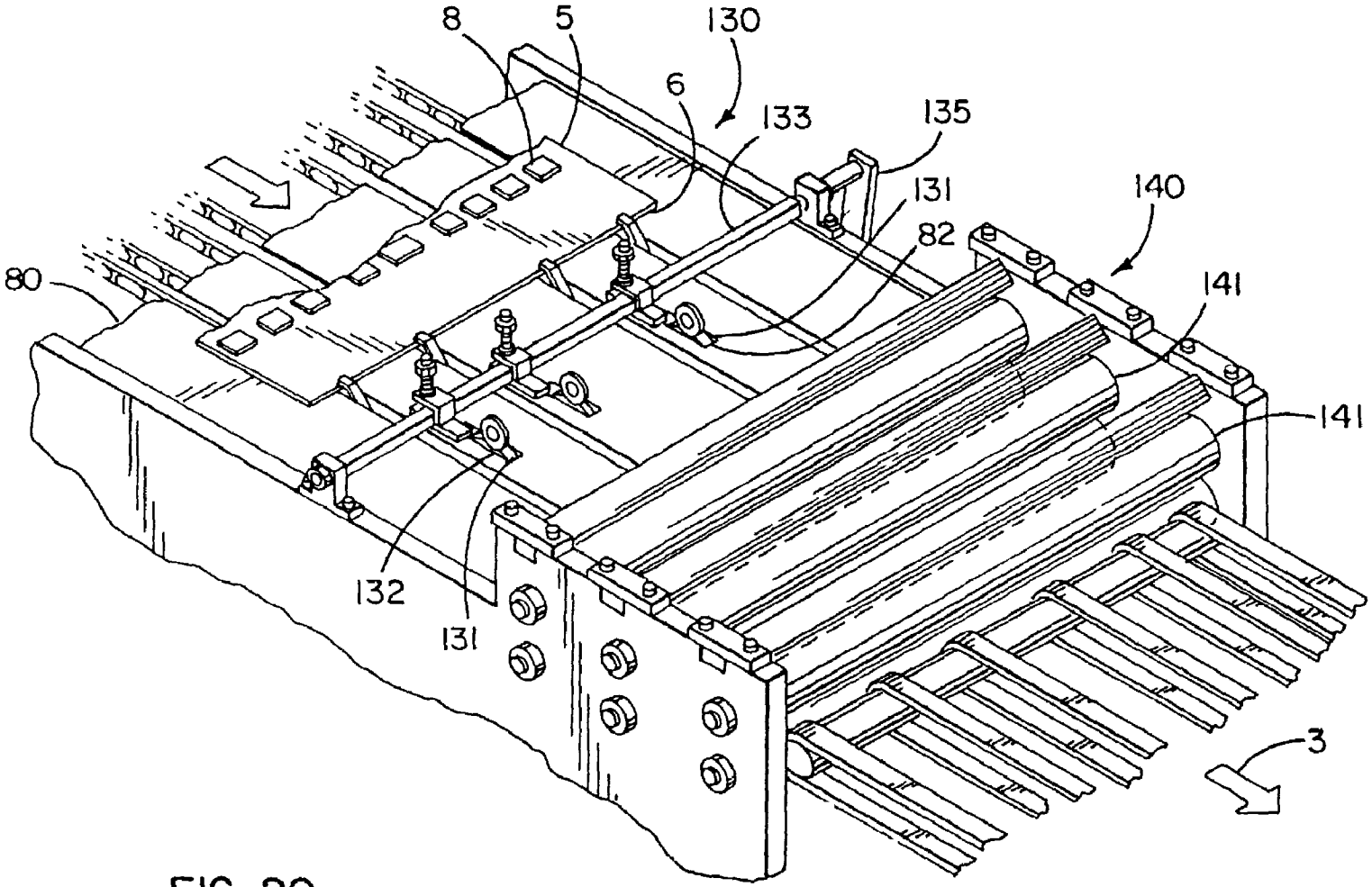
FIG. 20 is a perspective view of the disengaging station and pressing station of the apparatus of FIG. 1.
Figure 21:
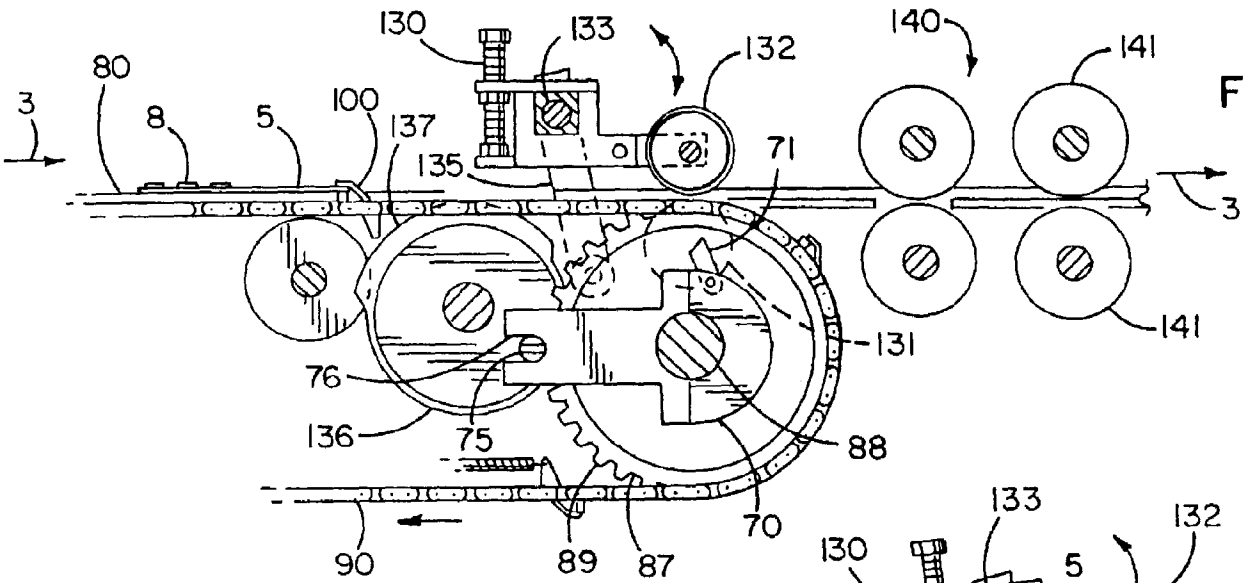
FIG. 21 is an elevation view of the disengaging station and pressing station with the hold-down arm in its lower position and the gripper mechanism in its closed position with a sheet therein prior to contact with the cam member.
Figure 22:
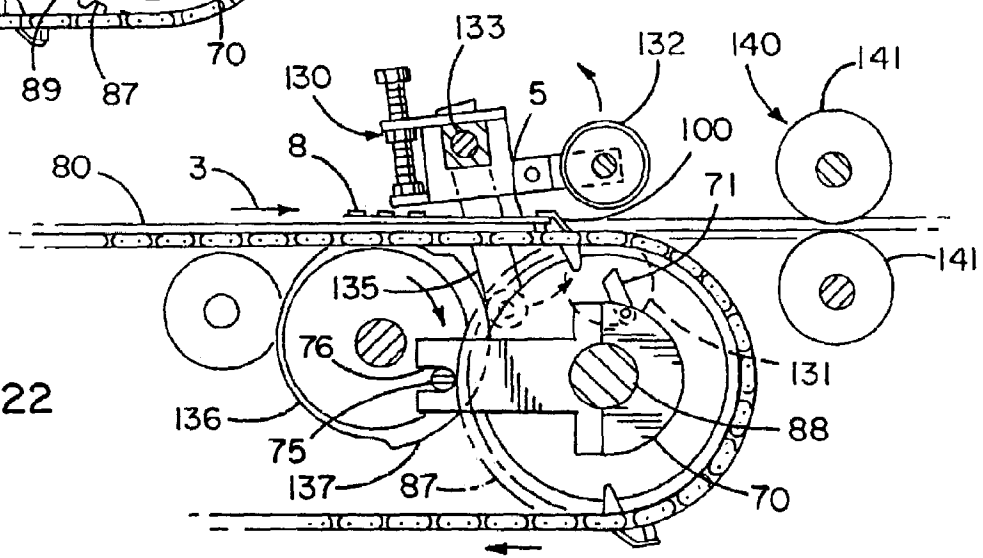
FIG. 22 is an elevation view similar to FIG. 21 with the hold-down arm in its upper position and the gripper mechanism in its closed position with a sheet therein prior to contact with the cam member.
Figure 23:
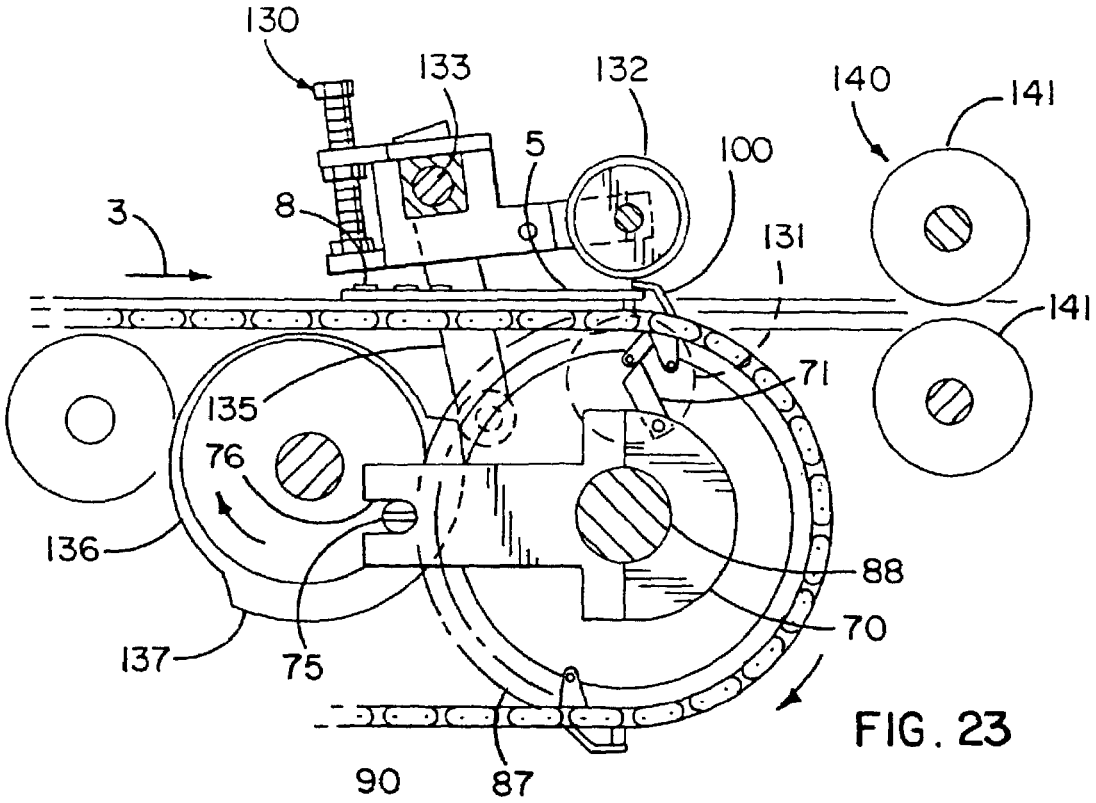
FIG. 23 is an elevation view similar to FIGS. 21 and 22 with the hold-down arm in its upper position and the gripper mechanism in its open position with a sheet therein during contact with the cam member.
Figure 24:
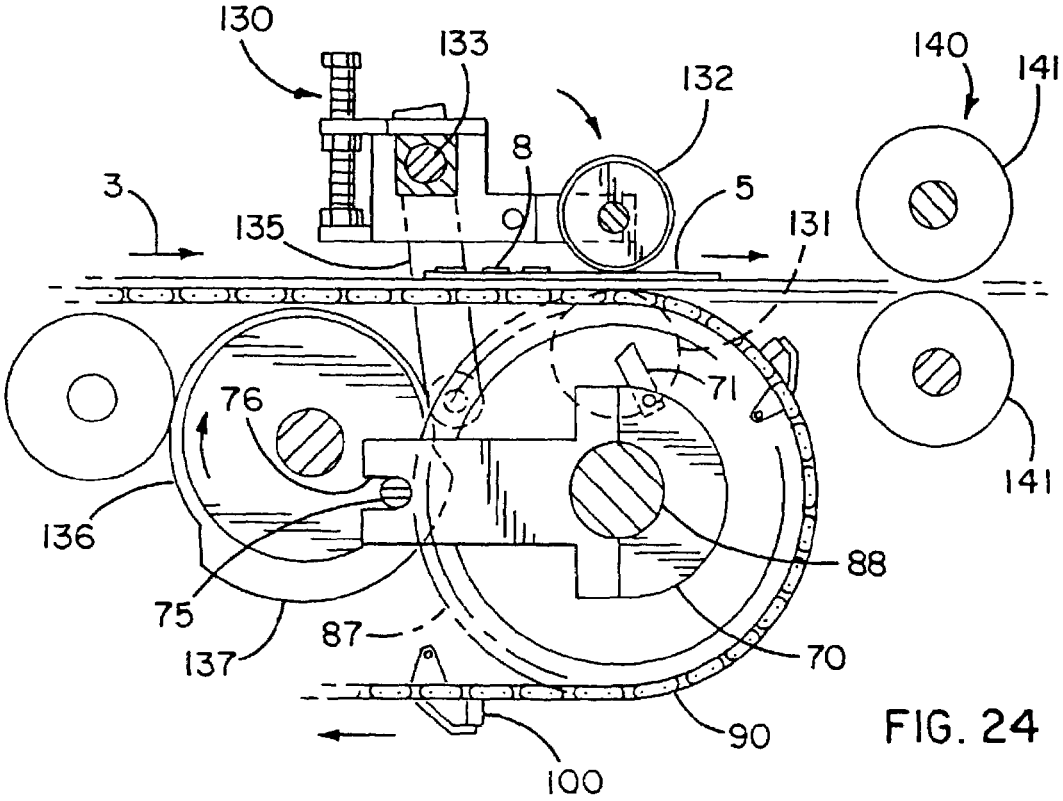
FIG. 24 is an elevation view similar to FIGS. 21–23 with the hold-down arm in its lower position and the gripper mechanism in its closed position after contact with the cam member and the sheet being fed in the direction of travel by the disengaging wheel.

The disengaging station 130 includes the cam discs 70 and the drive sprockets 87, as illustrated in FIGS. 20 and 21. The disengaging station 130 has rotating disengagement wheels 131 disposed beneath the travel surfaces 80. The rotating disengagement wheels 131 are mounted and sized such that they project through slots 82 formed in the travel plates 80. Above the rotating disengagement wheels 131 are multiple hold-down wheels 132. The hold-down wheels 132 are freely rotatable and are mounted to a hold-down shaft 133 that is pivotable between an upper or clearance position and a lower or contact position. A disengaging bar 135 is attached to the hold-down shaft 133. Rotation of a disengaging cam wheel 136, synchronized with the rotation of the drive sprocket 87, causes a disengaging cam 137 to contact the disengaging bar 135 and pivot the hold-down shaft 133, thereby moving the hold-down wheels 132 to their upper position, as illustrated in FIG. 22. As the disengaging cam 137 on the disengaging cam wheel 136 rotates out of contact with the disengaging bar 135, the hold-down shaft 133 pivots, thereby moving the hold-down wheels 132 to their lower position, as illustrated in FIG. 23. When the hold-down shaft 133 is in its lower position the hold down wheels 132 rest on top of the disengagement wheels 131 forming a nip therebetween, as illustrated in FIG. 24.

Figure 25:
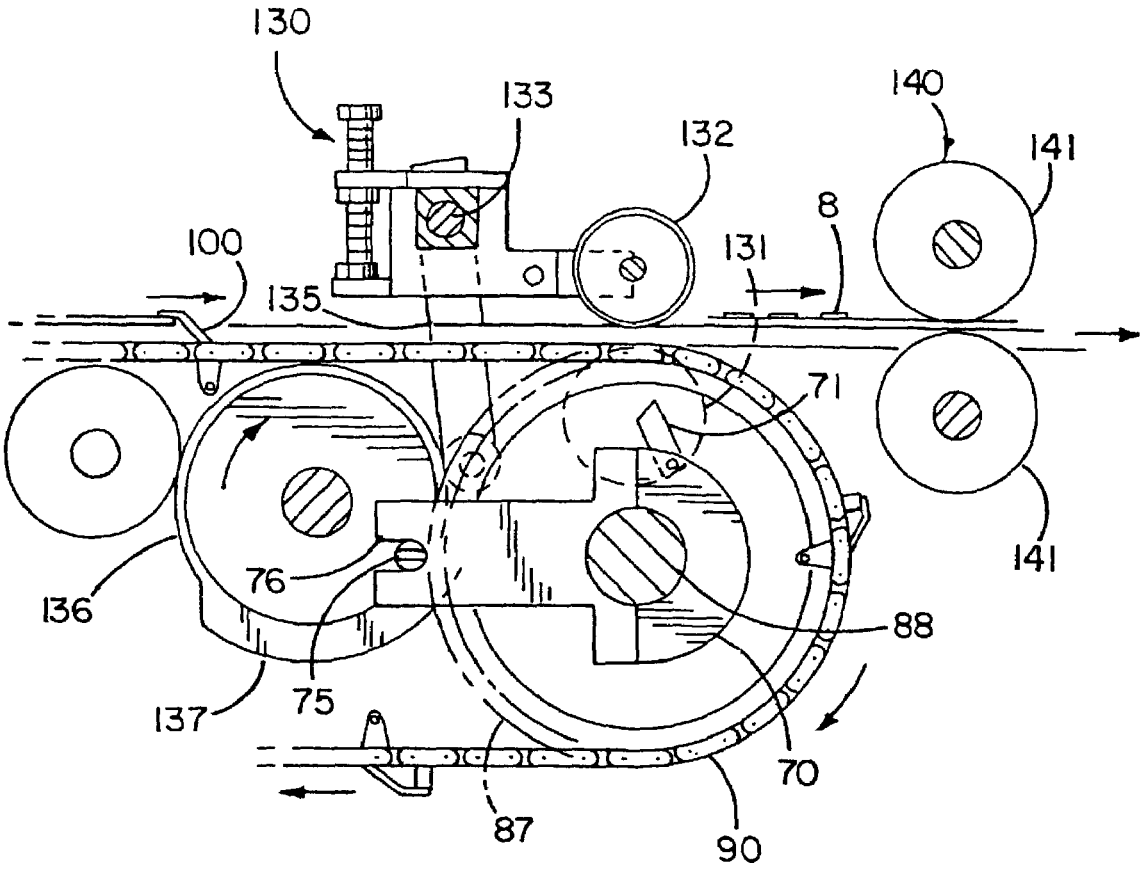
FIG. 25 is an elevation view similar to FIGS. 21–24 with the hold-down arm in its lower position and the gripper mechanism in its closed position after contact with the cam member and the sheet being fed in the direction of travel by the pressing rollers.

As the gripper mechanism 100 travels over the cam members 71 of the cam discs 70, the gripper mechanism 100 moves to its open position. The hold down shaft 133 with mounted hold-down wheels 132 is in its upper position, as illustrated in FIG. 22 and described hereinabove. As the leading edge 6 of the sheet 5 is positioned over the rotating disengagement wheels 131 and the gripper mechanism 100 is in its open position, the hold-down shaft 133 pivots to its lower position with the hold-down wheels 132 maintaining the sheet 5 in contact with the disengagement wheels 131, as illustrated in FIGS. 23–24. The rotation of the disengagement wheels 131 causes the sheet 5 to move from between the open jaws 101 and 103 of the gripper mechanism 100 and in the direction of travel 3 to the pressing station 140, as illustrated in FIG. 25.

The pressing station 140 has a series of pressing rollers 141 mounted downstream of the disengaging station 130. The pressing rollers 141 move the sheet 5 in the direction of travel through the pressing station 140. The pressing rollers 141 comprise steel cylinders with substantially smooth surfaces formed thereon. An upper pressing roller 141 is provided above a lower pressing roller 141 to form a nip therebetween so that when the sheet 5 is fed thereto, the rotating rollers will draw the sheet through the nip and discharge it therefrom. Multiple sets of upper and lower pressing rollers 141 are preferably provided. The pressing rollers 141 press the swatches 8 to the adhesive or glue spots 7 on the sheet 5 and ensure proper contact therebetween.

As the pressing rollers 141 feed the sheet 5 to the end of the pressing station 140, various other stations may be mounted for receiving the sheets 5 with swatches 8 applied thereon. For example, a folding station (not shown) may be desired to automatically fold the sheets 5. A slicing station (not shown) may be desired to cut the sheets 5 into smaller sheets.

Figure 33:
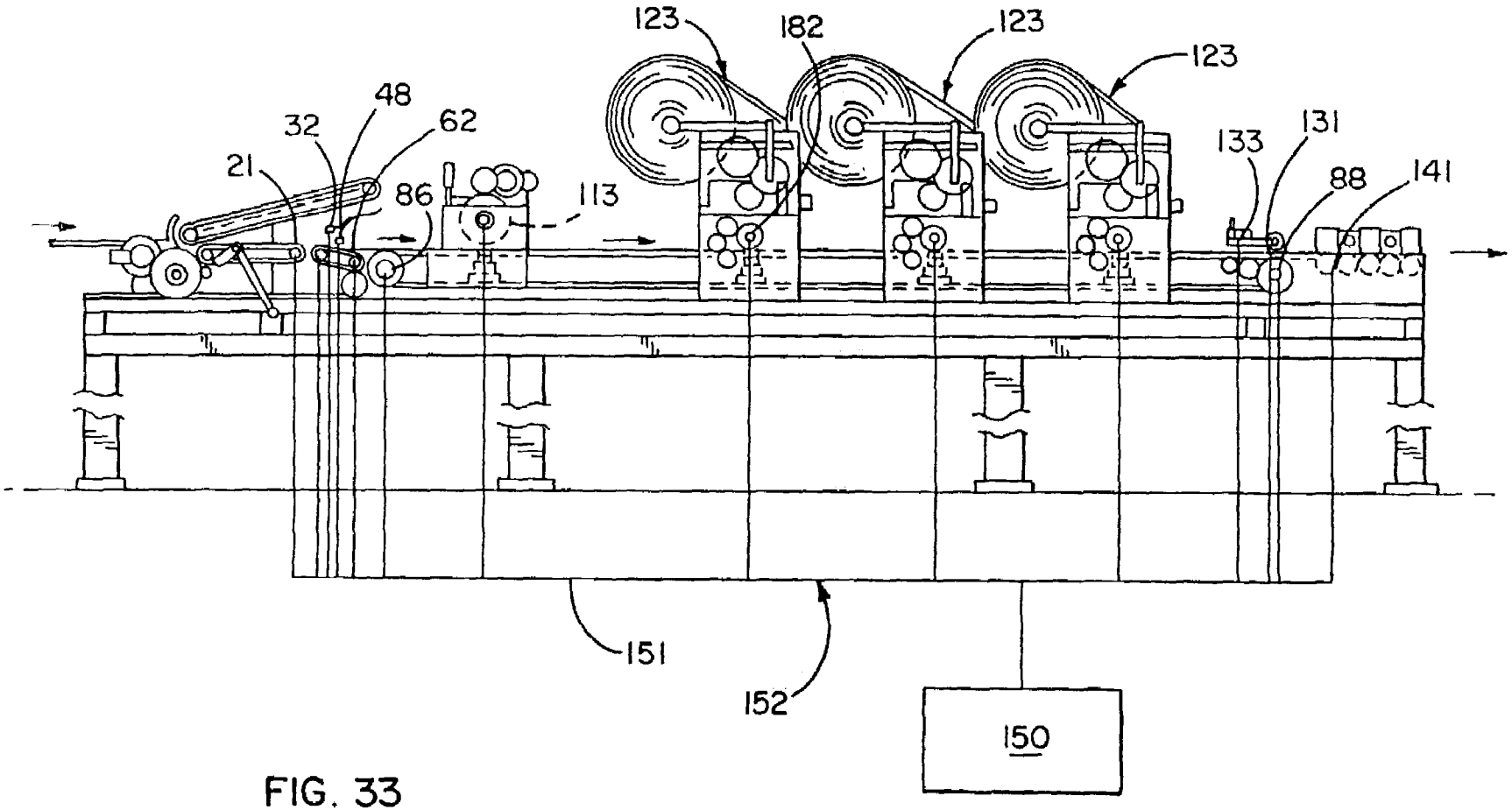
FIG. 33 is an elevational view of the apparatus of FIG. 1 schematically showing the drive shaft and the drive motor.

The speed of the swatch applying machinery 1 is controlled by a drive system, generally designated with numeral 152, as schematically illustrated in FIG. 33. A drive motor 150 drives common shaft 151. The common shaft 151 is coordinated with the rotating suction wheel shaft 21, the feed belt drive rollers 32, the suction feeder shaft 62, the idler shaft 86, the drive shaft 88, the application roller 113, the transfer roller 182, the rotating disengagement wheels 131, the hold-down shaft 133, and the pressing rollers 141. Thus, adjustments to the speed of the common drive motor 150 controls the speed that sheets 5 are fed to the gripper mechanisms 100 and pulled through the swatch applying machinery 1.

Multiple optical sensors 227 are placed throughout the apparatus 1 to detect the presence of sheets 5. Optical sensors 227 are preferably placed directly before the sheet stop 50 and before and after the adhesive applying station 110 to detect the presence of sheets 5. If sheets 5 are not detected at the appropriate times by the sensors 227, the drive motor 150 is stopped and the operation of the apparatus 1 is paused. The sensor 227 after the adhesive applying station 110 counts the number of sheets 5 fed thereover to maintain an accurate count of sheets 5 run through the apparatus 1. In addition, an optical beam snot shown) is emitted from an emitter 228 to detect errors in the feeding of the sheets 5. The optical beam projects from the emitter 228 across the travel plates 80 and generally perpendicular to the direction of travel to a reflector 229 disposed on an opposite side of the travel plates 80 from the emitter 228. The beam is preferably placed before the adhesive applying station 110 and at a height above the elevation that the gripper mechanisms 100 protrude through the slots 81 in the travel plates 80. If the gripper mechanism 100 is not below the maximum height that the mechanism 100 is allowed to protrude above the surface of the travel plates 80, then the errant portion extending thereabove will break the beam and trigger the stoppage of the apparatus 1.

Figure 26:
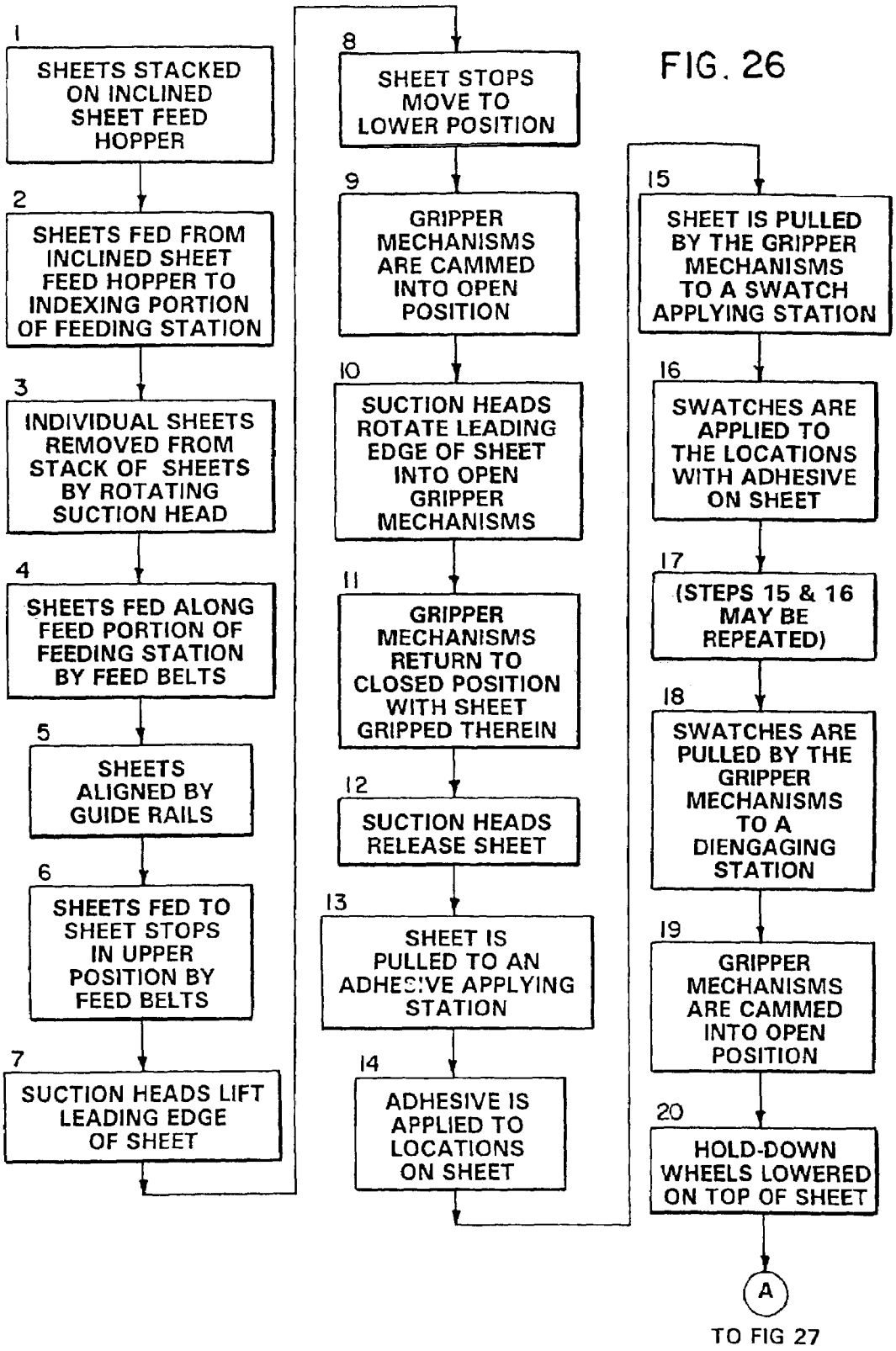
FIGS. 26 and 27 are a flow diagram of the method of operation of the apparatus of FIG. 1.
Figure 27:
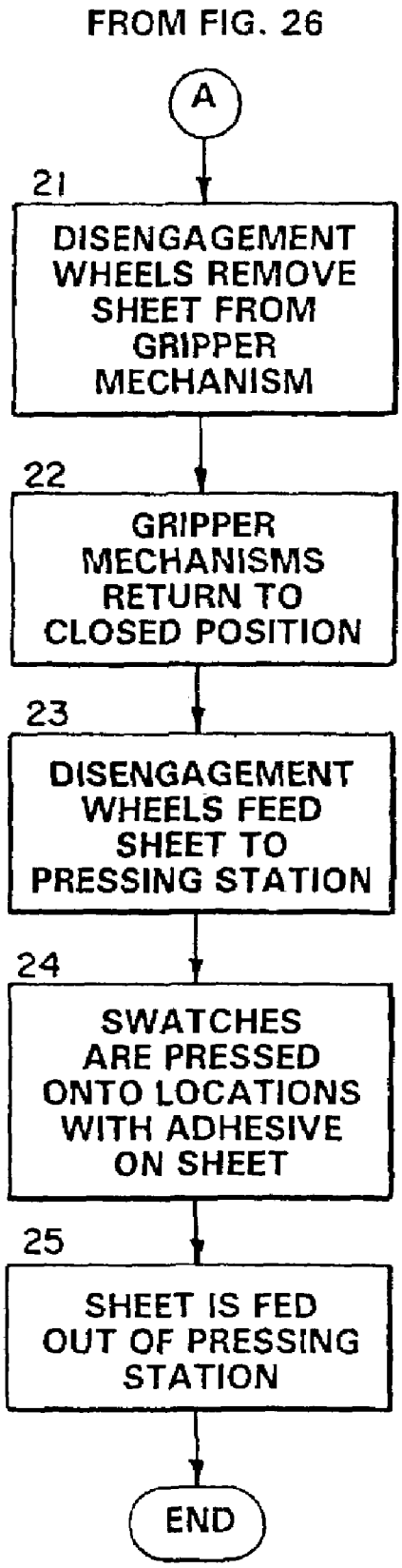

The method of operation of the apparatus 1 for applying swatches 8 to sheets 5 is set forth in FIGS. 26 and 27 and discussed in more detail hereinbelow. Sheets 5 begin stacked on an inclined sheet feed hopper 11. Belts 16 advance the stack of sheets 5 to the indexing portion 14 of the feeding station 10. The rotating suction wheel 20 removes individual sheets 5 from the stack of sheets 5 and feeds them to the feed portion 15 of the feeding station 10. Feed belts 31 advance the sheets 5 along the feed portion 15 of the feeding station 10. As the sheets 5 are advanced along the feed portion 15 of the feeding station 10, the pusher plate 42 shifts perpendicular to the downstream direction of travel 3 and towards the guide rail 41, thereby aligning the sheet 5 against the spring member 43 on the guide rail 41. The sheet 5 is fed to the end of the feed portion 15 of the feeding station 10 by the feed belts 31 until the leading edge 6 of the sheet 5 abuts against the stop members 52.

When the leading edge 6 of the sheet 5 abuts against the stop members 52, vacuum is applied to the suction heads 61 of the suction feeder 60, thereby drawing the leading edge 6 of the sheet 5 up from the surface of the feed plate 30 and against the vacuum heads 61. The vacuum heads 61 then pivot, coincidently pivoting the leading edge 6 of the sheet 5 drawn by the vacuum thereto, in the direction of travel 3 while the stop members 52 simultaneously pivot below the surface of the feed plate 30. As the vacuum heads 61 pivot, a set of gripper mechanisms 100 disposed between the endless chains 90 are cammed into their open positions by cam members 71 disposed on cam discs 70 as the endless chains 90 rotate around the idler sprockets 85. As the suction heads 61 pivot to the top of their arc of travel, the leading edge 6 of the sheet 5 is positioned between the open jaws 101 and 103 of the gripper mechanisms 100.

When the leading edge 6 of the sheet 5 abuts against the sheet stops 171 of the gripper mechanisms 100, the gripper mechanisms 100, continuing their rotation around the idler sprockets 85 and in the direction of travel 3, moves out of contact with the cam members 71, thereby allowing the bias of the springs 106 to return the gripper mechanisms 100 to their closed positions with the leading edge 6 of the sheet 5 clamped therebetween. When the leading edge 6 of the sheet 5 is clamped between the upper and lower jaws 101 and 103 of the gripper mechanisms 100, the vacuum is removed from the suction heads 61, releasing the leading edge 6 of the sheet 5 from the suction heads 61. The suction heads 61 then pivot back to their original position to draw a next sheet 5 from the feed plate 30 thereto.

With the leading edge 6 of the sheet 5 firmly clamped therein, the gripper mechanisms 100 pull the sheet 5 in the downstream direction of travel through the operating stations 160. The first operating station 160 is the adhesive applying station 110. As the gripper mechanisms 100 pull the sheet 5 therethrough, the application roller 114 rotates the application pads 112 with glue thereon against on the sheet 5, thereby placing glue spots 7 in the predetermined swatch 8 locations while pressing the sheet 5 against the concave bar 185.

Figure 29:
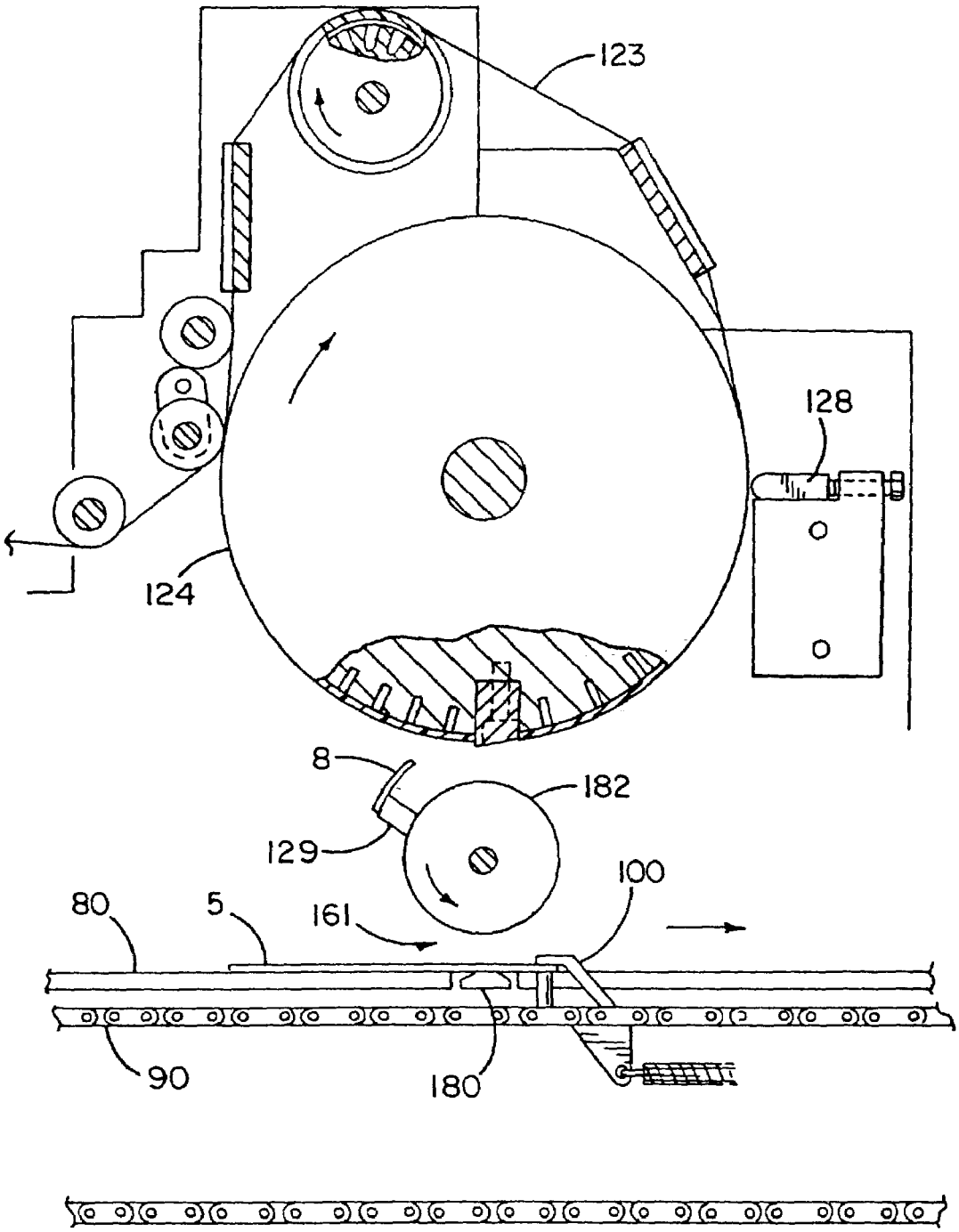
FIG. 29 is an elevational view partially in section of one of the swatch applying stations of FIG. 1 showing a sheet being pulled therethrough, the rocker bar in its raised position, and a swatch on the suction strip.
Figure 30:
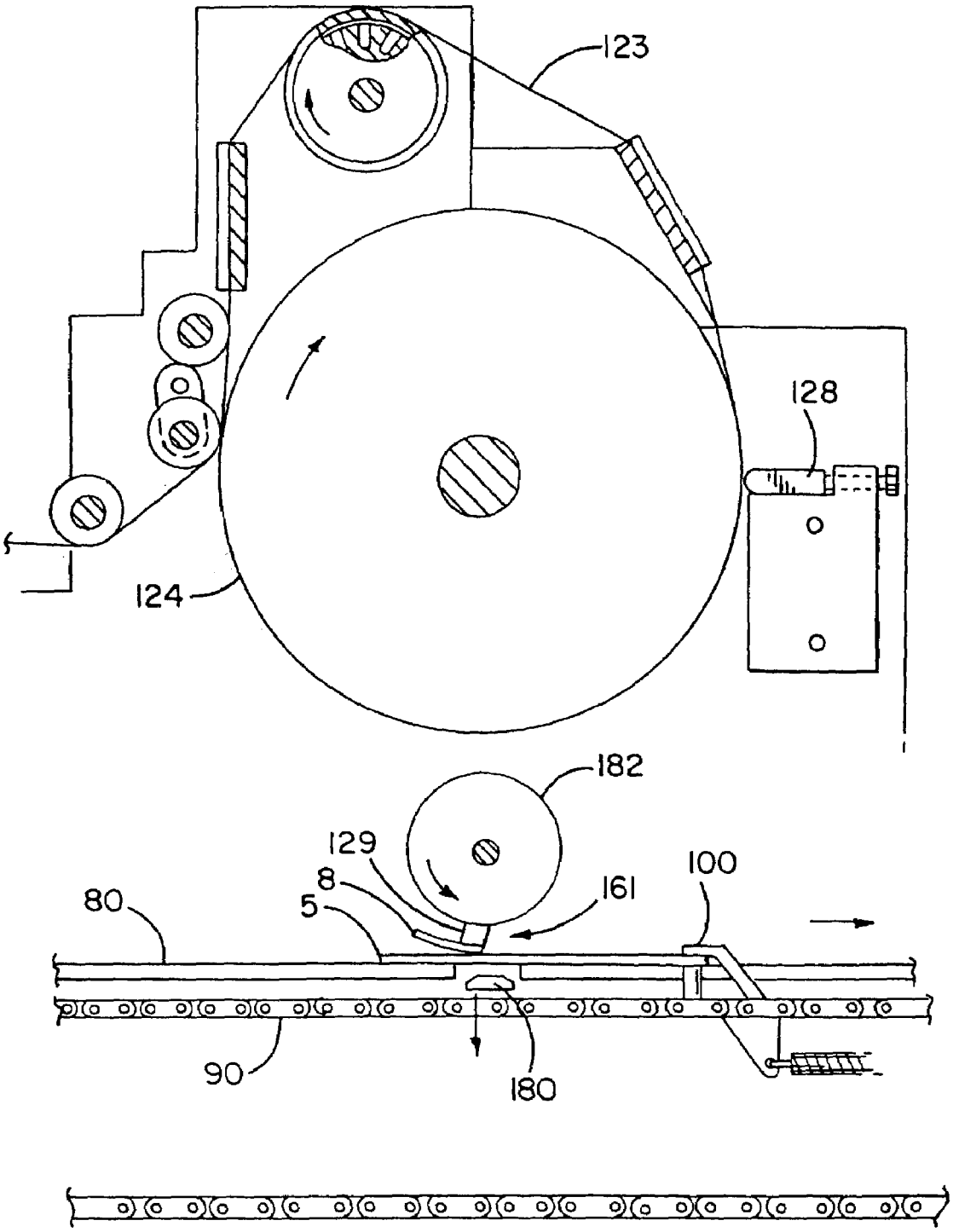
FIG. 30 is an elevational view similar to FIG. 29 showing the rocker bar in its lower position and the swatch beginning to be applied to the sheet.
Figure 31:
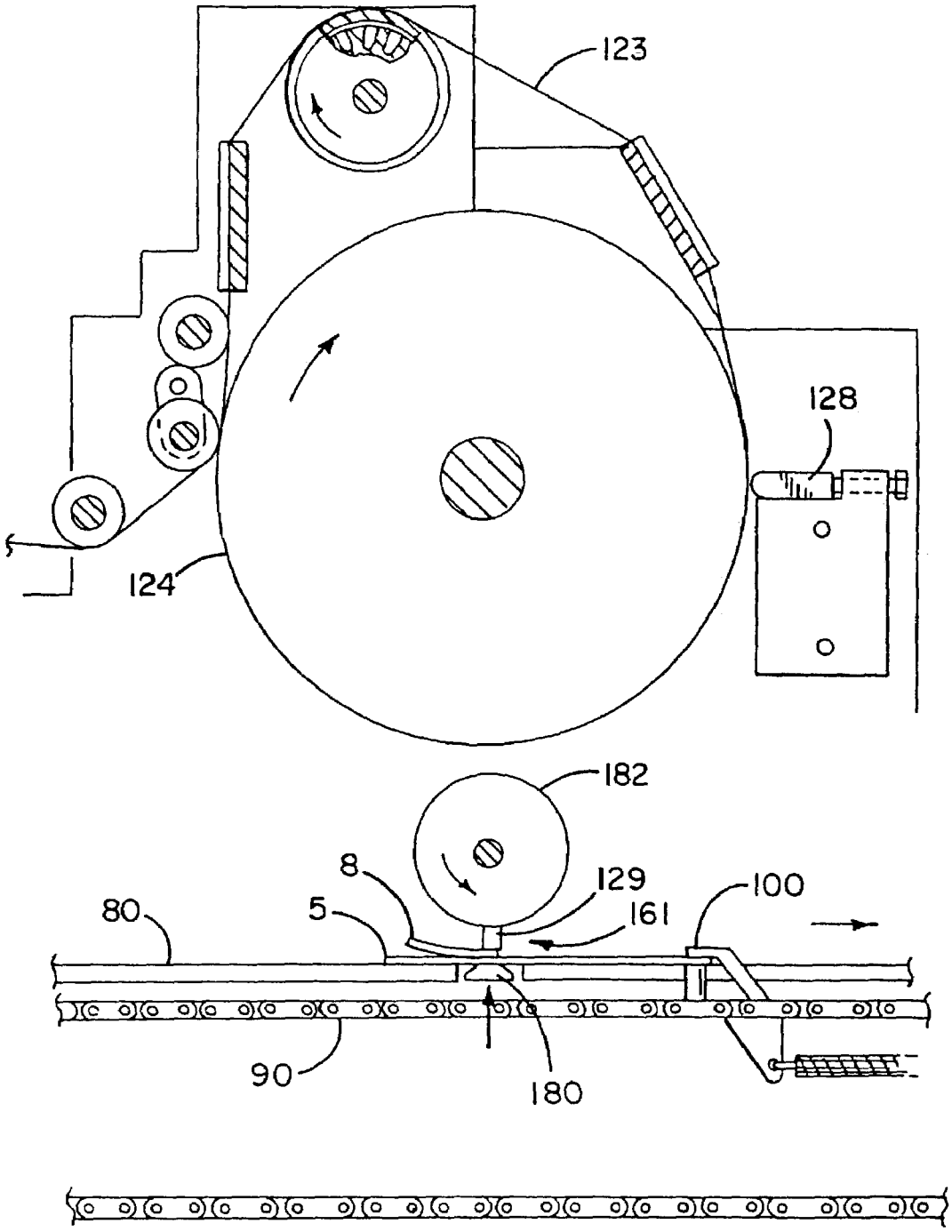
FIG. 31 is an elevational view similar to FIGS. 29–30 showing the rocker bar returned to its raised position and the swatch being applied to the sheet.
Figure 32:
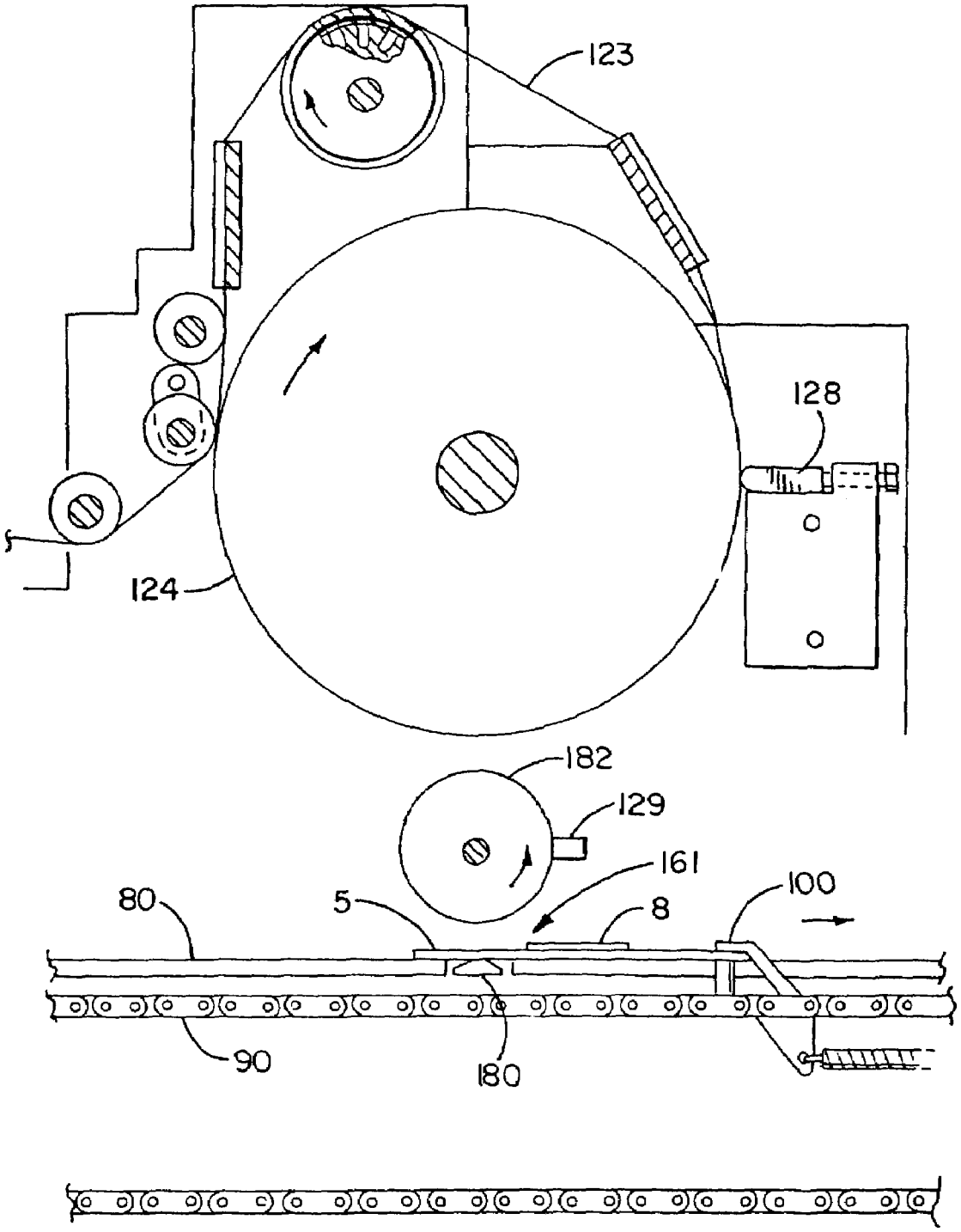
FIG. 32 is an elevational view similar to FIGS. 29–31 showing the rocker bar in its raised position and the swatch applied to the sheet.

Next, the gripper mechanisms 100 pull the sheet 5, with glue spots 7 thereon, through one or more swatch applying stations 120. As the sheet 5 is pulled through the swatch applying stations 120, ribbon 123 is unwound from rolls 121 of ribbon 123. The ribbon 123 is severed into swatches 8 by the severing blade 125 contacting the severing bar 128. The swatches 8 are held by a vacuum against the suction holes 126 of the swatch roller 124. The vacuum is released from the swatch roller 124, allowing the swatches 3 to adhere to the suction strip 129 of the transfer roller 182. After the gripper mechanisms 100 have passed the rocker bar 180, as illustrated in FIG. 29, the rocker bar 180 rocks into its lower position coinciding with the swatches 8, adhered by vacuum to the swatch strip 129 on the transfer roller 182, being placed on the glue spots 7 on the sheet 5, as illustrated in FIG. 30. When the swatch 8 is placed on the glue spot 7, the rocker bar 180 rocks back to its upper position and the vacuum is removed from the swatch strip 129, releasing the swatch 8 therefrom, as illustrated in FIG. 31. The gripper mechanisms 100 then continue to pull the sheet 5 in the downstream direction of travel 3, as illustrated in FIG. 32.

After pulling the sheet 5 through the operating stations 160, the gripper mechanisms 100 release their clamp on the sheet 5 at the disengaging station 130. As the gripper mechanisms 100 pull the leading edge 6 of the sheet 5 over the rotating disengagement wheels 131, rotating at the same speed as the endless chains 90, the hold-down wheels 132 are in their upper or clearance position. As the gripper mechanisms 100 are cammed by the cam members 71 on the cam discs 70 by the drive sprockets 87 to their open positions, the hold-down wheels 132 pivot to their lower or contact position, pressing the sheet 5 onto the rotating disengagement wheels 131. With the gripper mechanisms 100 remaining cammed in their open positions, the sheet 5 is removed from therein by nip formed between the rotating disengagement wheels 131 and the hold-down wheels 132 in their lower positions.

The sheet 5 is pushed by the rotating disengagement wheels 131 to the pressing station 140. At the pressing station 140 the sheet 5 is pressed and fed forward by the nips formed between sets of pressing rollers 141, each set comprising a pressing roller 141 below the sheet 5 and a pressing roller 141 above the sheet 5. The pressing rollers 141 press the swatches 8 firmly onto the glue spots 7 on the sheet 5. The sheet 5 is advanced by the rotation of the pressing rollers 141 out of the pressing station 140 and to any subsequent processing stations (not shown).

From the foregoing, it will be appreciated that the invention provides a method and apparatus for manufacture of swatch bearing sheets. While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

The invention claimed is:

1. An apparatus far adhering paint chips on sheets at predetermined locations thereon, the apparatus comprising:

a plurality of stations including at least one adhesive applying station upstream from swatch applying stations that deposit paint chips onto adhesive transferred to the sheets at the adhesive station;

a conveyor for advancing the sheets from upstream to downstream through the plurality of stations;

a sheet feeder upstream of the conveyor for sequentially supplying the sheets to the conveyor;

at least two gripping mechanisms connected to the conveyor and having an open state facing upstream for receiving sheets and a closed state for holding sheets received therein, the gripping mechanisms laterally disposed from each other along an axis perpendicular to the direction of the downstream advancement of the sheets;

an elongated support surface extending from the sheet feeder downstream; and a drive system for the conveyor and sheet feeder that coordinates timing of the supply of the sheets by the sheet feeder to the gripping mechanisms so that the gripping mechanisms shift between the open and closed states as an individual sheet is received therein with the gripping mechanisms closing onto a downstream edge of the received sheet for substantially reducing sheet float when the individual sheet is pulled generally in a plane over the support surface from upstream to downstream without opening the mechanisms as the individual sheet is pulled through the stations.

2. The apparatus of claim 1 wherein the gripping mechanisms include pivotal members having ends that are pivoted away from each other in the open state to face upstream toward the sheet feeder, the ends being pivoted toward each other in the closed state to clamp onto the individual sheet for pulling the individual sheet downstream.

3. The apparatus of claim 2 wherein the conveyor is an endless conveyor for moving the sheets downstream between a sheet supply end and a sheet discharge end with the stations therebetween, and opening mechanisms at positions at the sheet supply and discharge ends of the endless conveyor cooperate with the gripping mechanisms to shift the gripping mechanisms to the open state for receiving the individual sheet at the supply end and for releasing the sheets at the discharge end.

4. The apparatus of claim 3 wherein the gripping mechanisms include pivotal members, and at least one cam mechanism at a position along the conveyor adjacent the sheet feeder for pivoting the gripping mechanisms to the open state as the gripping mechanisms travel past the cam mechanism.

5. The apparatus of claim 4 wherein the gripping mechanisms include a biasing mechanism for urging the pivotal members to the closed state with a bias force to securely hold the individual sheets received therein with the cam mechanism being operable to shift the pivotal members to the open state against the bias force.

6. The apparatus of claim 5 wherein the conveyor further includes lateral guides downstream of the sheet feeder at the upstream end of the conveyor, the lateral guides adjustable to align the individual sheets received from the feeder on the conveyor for downstream travel of the individual sheets through the stations with the gripping mechanisms operable between the guides to hold the individual sheets and pull the aligned sheets through the stations.

7. An apparatus for adhering swatches on individual sheets at predetermined locations thereon, the apparatus including:

at least one adhesive applying station for depositing adhesive on the individual sheets at predetermined locations on the sheet;

one or more swatch applying stations for placing swatches on the adhesive at the predetermined locations on the sheet;

an elongated support surface extending from upstream to downstream;

at least two sets of gripping jaws, each set having an upper and lower gripping jaw for pulling a downstream edge of the sheet through and under the adhesive applying station and the swatch applying stations, each set of gripping jaws being disposed laterally from each other along an axis perpendicular to the elongated support surface, the gripping jaws shifting between the open and closed states as the individual sheet is received therein with the gripping jaws closing onto the downstream edge of the received sheet for substantially reducing sheet float when the individual sheet is pulled generally in a plane over the support surface from upstream to downstream without opening the jaws as the individual sheet is pulled through and under the adhesive applying station and the swatch applying stations.

8. An apparatus for moving a sheet through machinery for applying swatches to sheets, the apparatus comprising:

a feeding station for separating an individual sheet from a plurality of sheets in a stack and feeding the separated individual sheet;

an endless flexible drive;

an elongated sheet support surface extending from the upstream to the downstream for support of the sheet while traveling downstream;

at least two pairs gripping jaws affixed to the endless flexible drive, the gripping jaws facing upstream for gripping an upstream edge of the sheet;

an adhesive applying station for applying glue to the sheet;

one or more swatch applying stations each having one or more operating cylinders having an axis of rotation perpendicular to the machine feed direction for applying one or more swatches to the sheet; and a receiving station for receiving the sheet after the sheet has been through the adhesive applying station and the swatch applying station, each of the at least two pairs of the gripping jaws pivoting on a pivot axis perpendicular to the movement of the sheet moving downstream the jaws pivoting to an open position and a closed position, each pair of the gripping jaws being disposed laterally from each other along an axis perpendicular to the elongated sheet support surface; and the gripping jaws in the closed position for pulling the downstream edge of the sheet from the feeding station downstream through the adhesive applying station and through the swatch applying station to the receiving station, the gripping jaws passing beneath at least one of the one or more operating cylinders of at least one of the one or more swatch applying stations.

9. The apparatus in accordance with claim 8 wherein the gripping jaws are hinged together by a pivot pin which has it longitudinal axis perpendicular to the downstream movement of the sheet.

10. The apparatus in accordance with claim 8 wherein the endless flexible drive is a chain and the apparatus further includes a forward gear with a cam downstream and adjacent to the feeding station and a rearward gear with a cam upstream and adjacent to the receiving station, the chain revolving the forward and rearward gears, the cams operably connected to the jaws to close the jaws at the forward gear and open the jaws and the rearward gear.

11. The apparatus in accordance with claim 10 wherein each pair of the gripping jaws include a lower jaw and upper jaw, the lower jaw pivots about the pivot axis relative to the upper jaw to bring the gripping jaws from a closed position to the open position during contact with the cam by the forward gear or the rearward gear.

12. The apparatus in accordance with claim 11 wherein each pair of the gripping jaws are biased towards the closed position by a spring, wherein a gripping arm extending from the upper jaw contacts a gripping tab extending from the lower jaw when the gripping jaws are in the closed position.

13. The apparatus in accordance with claim 8 wherein the elongated support surface plates includes slots in which the gripping jaws travel downstream.

14. The apparatus in accordance with claim 7 wherein the gripping jaws are hinged together by a pivot pin which has it longitudinal axis perpendicular to the downstream movement of the sheet.

15. The apparatus in accordance with claim 14 wherein the apparatus further includes an endless flexible drive for moving the gripping jaws downstream, a feeding station for separating an individual sheet from a plurality of sheets in a stack and feeding the separated individual sheet, a receiving station for receiving the sheet after the sheet has been through the adhesive applying station and swatch applying station, a forward gear with a cam downstream and adjacent to the feeding station and a rearward gear with a cam upstream and adjacent to the receiving station, the flexible drive revolving the forward and rearward gears, the cams operably connected to the jaws to close the jaws at the forward gear and open the jaws and the rearward gear.

16. The apparatus in accordance with claim 15 wherein the lower gripping jaw pivots about the pivot axis relative to the upper jaw to bring the gripping jaws from a closed position to the open position during contact with the cam by the forward gear or the rearward gear.

17. The apparatus in accordance with claim 14 wherein the gripping jaws are biased towards the closed position by a spring, wherein a gripping arm extending from the upper jaw contacts a gripping tab extending from the lower jaw when the gripping jaws are in the closed position.

18. The apparatus in accordance with claim 16 wherein the gripping jaws are biased towards the closed position by a spring, wherein a gripping arm extending from the upper jaw contacts a gripping tab extending from the lower jaw when the gripping jaws are in the closed position.

19. The apparatus in accordance with claim 7 wherein the elongated support surface supports the sheet as the gripping jaws pull the sheet downstream, the elongated support surface including slots in which the gripping jaws travel downstream.

20. The apparatus in accordance with claim 14 wherein the elongated support surface supports the sheet as the gripping jaws pull the sheet downstream, the elongated support surface including slots in which the gripping jaws travel downstream.

* * * * *

UNITED STATES PATENT AND TRADEMARK OFFICE

CERTIFICATE OF CORRECTION

PATENT NO. : 7,017,640 B2
APPLICATION NO. : 10/071678
DATED : March 28, 2006
INVENTOR(S) : Steven B. Winter et al.

It is certified that error appears in the above-identified patent and that said Letters Patent is hereby corrected as shown below:

ON THE TITLE PAGE:

(76) Inventors, line 1, delete "2139 Grange Ave.," and insert --2801 Ridge,-- therefor.
(56) Foreign Patent Documents, first entry (FR 2717165 A1), after "9/1995" insert --B65H 39/14--.

IN THE CLAIMS:

Column 28, line 18, delete "far" and insert --for-- therefor.
Column 29, line 54, after "pairs" insert --of--.
Column 30, line 37, after "surface" delete "plates".

Signed and Sealed this

Twenty-fourth Day of July, 2007

JON W. DUDAS
*Director of the United States Patent and Trademark Office*